United States Patent [19]

Kane

[11] 4,334,230

[45] Jun. 8, 1982

[54] DIRECTIVITY-CONTROLLABLE ANTENNA SYSTEM

[75] Inventor: Johji Kane, Sakai, Japan

[73] Assignee: Matsushita Electric Industrial Co. Ltd., Osaka, Japan

[21] Appl. No.: 165,940

[22] Filed: Jul. 3, 1980

[30] Foreign Application Priority Data

Jul. 9, 1979 [JP] Japan ..... 54-86785
Jul. 9, 1979 [JP] Japan ..... 54-86788

[51] Int. Cl.[3] ..... H01Q 3/26; H01Q 21/26

[52] U.S. Cl. ..... 343/797; 343/854; 455/276

[58] Field of Search ..... 343/814, 854, 876, 797, 343/806; 455/272, 273, 275, 276, 277

[56] References Cited

U.S. PATENT DOCUMENTS

| | | | |
|---|---|---|---|
| 3,056,961 | 10/1962 | Mitchell | 343/876 |
| 4,123,759 | 10/1978 | Hines et al. | 343/854 |
| 4,193,077 | 3/1980 | Greenberg et al. | 343/876 |
| 4,213,133 | 7/1980 | Hidaka | 343/814 |

*Primary Examiner*—Eli Lieberman
*Attorney, Agent, or Firm*—Wenderoth, Lind & Ponack

[57] ABSTRACT

A variable tuning unit, including voltage variable-reactance circuits and a reactance element for adjusting the impedance, is electrically connected to the feed side of an antenna element which is formed of transmission lines in a zigzag configuration and having a distributed inductance, thereby constituting an antenna circuit. A plurality of reference dipole antennas forming such antenna circuits are provided to form an antenna configuration of the phased array type or Yagi type. Voltage variable-capacitors are interconnected within the voltage variable-reactance circuits and the feed terminal of the antenna configuration is connected to the input terminal of a remote radio receiver through a coaxial cable, so that RF signals received by the antenna are supplied to the receiver. A D.C. tuning control voltage, generated by the radio receiver, is fed to a voltage variable-capacitor within the voltage variable-reactance circuit by way of the coaxial cable.

A slightly different D.C. tuning control voltage is fed to each reference dipole antenna constituting the antenna configuration, so that the resonance of each reference dipole antenna is delayed to generate phase differences between the reference dipole antennas, resulting in the control of the directivity of the antenna configuration. The slight voltage differences of the D.C. tuning control voltages are controlled by a detected signal from the remote radio receiver. Hence, the controlled directivity antenna system forms a closed loop functioning to control the directivity of the antenna configuration on a basis of a received radio wave signal.

5 Claims, 121 Drawing Figures

$V_1=(V-\Delta V'')$
$V_2=V+\Delta V'')$ $V_1=(V-\Delta V')$
$V_2=(V+\Delta V')$ $V_1=V$
$V_2=V$ $V_1=(V+\Delta V')$
$V_2=(V-\Delta V')$ $V_1=(V+\Delta V'')$
$V_2=(V-\Delta V'')$
A
B $f_1 > f_2$
$|f_2 - f_1| = f_d$ $f_1 > f_2$
$|f_2 - f_1| < f_d$ $f_1 = f_2$
$|f_2 - f_1| = 0$ $f_1 < f_2$
$|f_2 - f_1| < f_d$ $f_1 < f_2$
$|f_2 - f_1| = f_d$

A ← → B

DIRECTIVITY-CONTROLLABLE ANTENNA SYSTEM

BACKGROUND OF THE INVENTION

One present day method to rotatably control the directivity of a directional antenna is to provide the mast upon which the antenna is attached with a rotator connected mechanically thereto and the rotation of the rotator is controlled to mechanically rotatably control the antenna, thereby setting the directivity.

This method, however, inevitably includes mechanically movable portions of very slow speed for rotatably controlling and setting the directivity.

This makes it impossible to presently achieve the follow-up function to automatically set the directivity of antenna in the optimum direction when the received radio waves rapidly change, or when the antenna receiving system moves incessantly. The above problem is worsened by multipath interference, in which the demodulated signal quality is severely deteriorated.

An antenna for a frequency band below the VHF band is very large-sized from a viewpoint of practical use, and is difficult to install and creates many problems in maintenance and safety.

For this reason, an antenna system is required which directionally rotates at high speed, and enables the directivity to be set automatically and electrically in the optimum direction, and has a good follow-up performance. The antenna system also is required to be composed of an antenna of small size and of high gain.

SUMMARY OF THE INVENTION

This invention relates to a receiving antenna for television wave signal in the VHF and UHF bands and the FM radio wave signal band, and also relates to a transmitting-receiving antenna for other communication uses.

An object of the invention is to provide an antenna system which directionally rotates at high speed, and is capable of setting the directivity automatically and electrically in the optimum direction, and is superior in its follow-up performance, and is small-sized while keeping high gain.

One embodiment of the directivity controllable antenna system is a receiving antenna system for FM radio receiving, including a radio receiver remote from its antenna.

The antenna system of the invention is so constructed that the feed side of antenna elements comprising transmission lines in a zigzag configuration and having a distributed inductance is electrically connected to a variable tuning unit including voltage variable-reactance circuits and an impedance adjusting reactance element, so that a plurality of reference dipole antennas constituting antenna circuits are provided to form an antenna configuration of the phased array type or Yagi type. Within the voltage variable-reactance circuit are interconnected voltge variable-capacitors. The antenna configuration terminals are connected to input terminals of the remote radio receiver by way of a coaxial cable so that RF signals received by the antenna are fed to the receiver. A D.C. tuning control voltage, generated by the radio receiver, is supplied to the voltage variable-capacitors within the voltage variable-reactance circuits of the antenna throuh the coaxial cable.

A slightly different D.C. tuning control voltage is supplied to each reference dipole antennas constituting the antenna configuration, so that the resonance of each reference dipole antenna is delayed to generate phase differences between the reference dipole antennas. As a result, the directivity of antenna configuration is controllable.

The slight voltage differences of the D.C. tuning control voltages are controlled by a detected signal from the remote radio receiver.

Hence, the controlled directivity antenna system forms a closed loop for functioning to control the directivity of the antenna configuration on a basis of a received radio wave signal.

The detected signal from the radio receiver is set according to its type, whereby the directivity of the antenna configuration, correspondingly to the above, is set automatically in the optimum direction with respect to the received radio wave signal.

The reference dipole antennas having distributed inductance are combined with variable tuning, thereby making it possible to improve the antenna radiation efficiency to the utmost extent and considerably reduce its size.

As seen from the above, the antenna system of this invention is able to automatically set the directivity of the antenna so that the signal fed to the input terminals of the receiver becomes maximum correspondingly to the station-selection thereof, or the signal fed to the input terminals of antenna is minimally affected by multipath reception, thereby considerably facilitating operation of a receiving device and automatically setting it always in its optimum receiving condition. Also, a directional change of the antenna is performable instantly and entirely electronically.

The dipole antennas of very small length in comparison with the wave length of the frequency in use and tunable at an individual frequency with respect to all bands in a range of necessary frequencies, can comprise elements of much smaller negative reactance and of very low loss, and much smaller positive reactance control circuits controlling to offset the much smaller negative reactance component, that is, a positive reactance control circuit of much smaller loss, thereby enabling the forming of a lightweight antenna having high performance gain and ultra-small size.

The antenna system of the invention presents narrow-band characteristics so as not to tune to signals other than the desired signal and has jamming signal elimination capability so as to demonstrate better receiving performance with respect to the receiver connected to this system.

An improvement in this system includes a memory which is provided to store control signals to set the antenna directivity in combination with a station-selection signal from the receiver, so that a pair of codes of both signals are previously stored in the memory to thereby read out an antenna directivity control signal code corresponding to the station-selection control signal, thus making it possible to set the antenna in the directivity optimum for its station-selection channel.

DETAILED DESCRIPTION OF THE PREFERRED EMBODIMENTS OF THE INVENTION

FIGS. 1 through 9 explain this invention relating to a system in which a pair of dipole antennas opposite to each other are disposed perpendicularly to a pair of dipole antennas opposite to each other so that an antenna unit comprising a total of four dipole antennas used as antenna elements is automatically set to an orientation in the optimum direction. An object of the invention is to provide an antenna system of small size using antenna elements shortened in length and to set the antenna system so as to be directive automatically and entirely electronically in the direction so as to minimize multipath reception of the received signal.

Figure 1A:
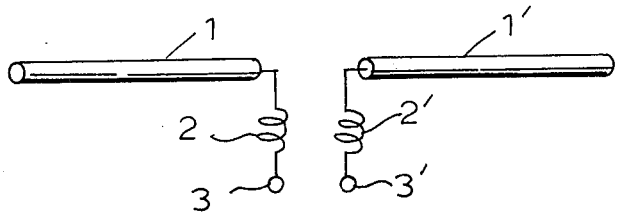
(PRIOR ART) FIG.1a
FIGS. 1-*a* and 1-*b* are views showing the construction of dipole antennas used for a conventional antenna device.
Figure 1B:
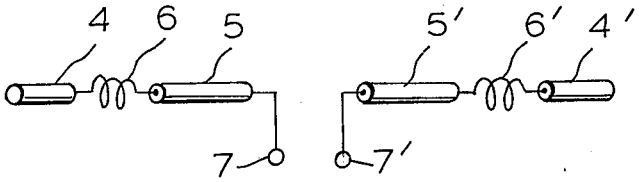
(PRIOR ART) FIG.1b

Generally, dipole antennas used in a four element antenna device, when the antenna elements are small-sized in comparison with wavelength of the frequency in use, have considerably decreased radiation resistance as compared with radiation reactance, whereby radiation efficiency lowers to reduce the actual gain of antenna. Therefore, it is difficult to form a small-sized antenna which doesn't lower the radiation efficiency even when using small-sized antenna elements and which has a high actual gain even when shortening the elements in length as small as a conventional antenna of small size. Conventionally, loaded antennas have been proposed as the small-sized antennas. Conventional shortened type dipole antennas are exemplified in FIGS. 1-*a* and -*b*. FIG. 1-*a* shows shortened elements 1 and 1' added with coils 2 and 2' having reactance components which cancel the reactance components of the elements so that impedance viewed from feed terminals 3 and 3' is a required resistance value at the required frequency. FIG. 1-*b* shows elements 4 and 5 having a coil 6 added therebetween and elements 4' and 5' having a coil 6' added therebetween, the coils 6 and 6' cancelling the reactance components of these shortened elements, so that the impedance viewed from feed terminals 7, 7' is a required resistance value at the required frequency. These dipole antennas, however, require that a large reactance be added to the shortened elements, whereby the problem of a large loss of each coil occurs. The coil loss deteriorates the radiation efficiency to lower the performance gain of the antenna, and thus the antenna is not suitable for practical use as the four element antenna.

In order to eliminate the conventional defects, this invention has been designed. An embodiment of the invention will be detailed according to the drawings.

Figure 3:
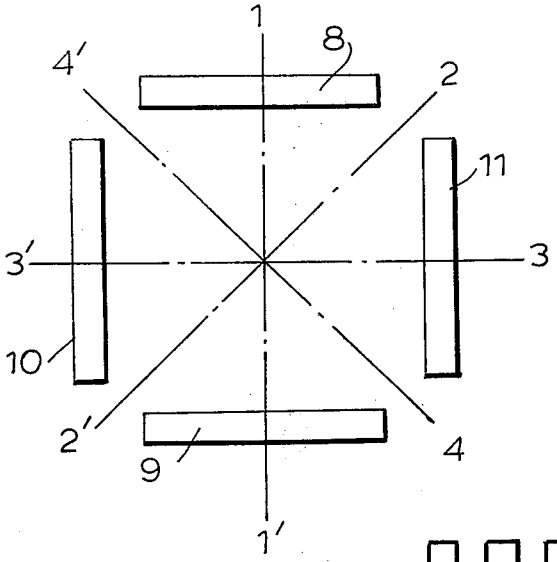
FIG. 3 is a view explanatory of the arrangement of antenna elements at the antenna unit.
Figure 2:
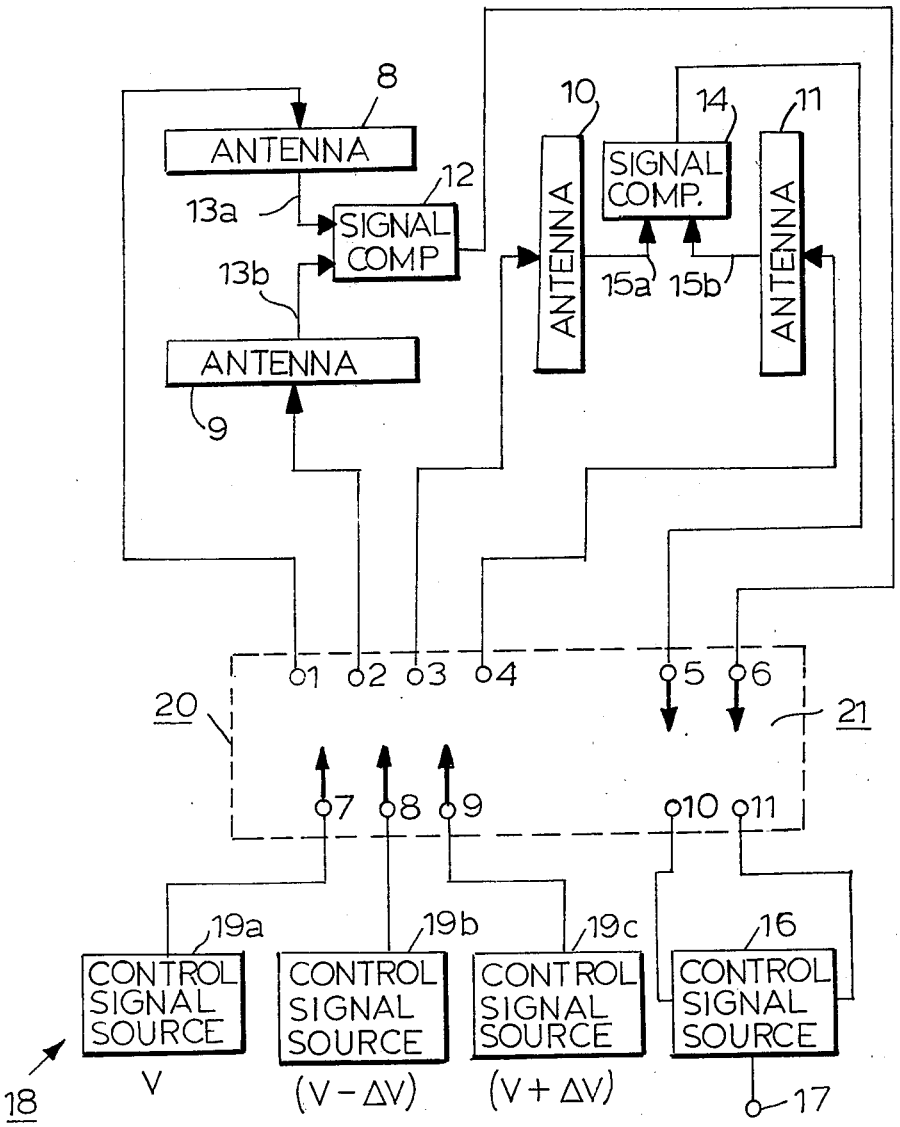
FIG. 2 is a block diagram of an embodiment of an antenna unit of the present invention.
Figure 5:
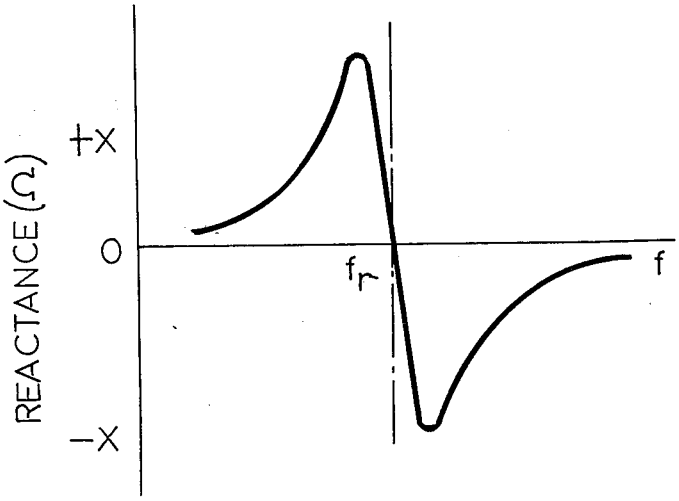
FIGS. 5 and 6 show the characteristics of the dipole antenna used in the antenna unit.
Figure 6:
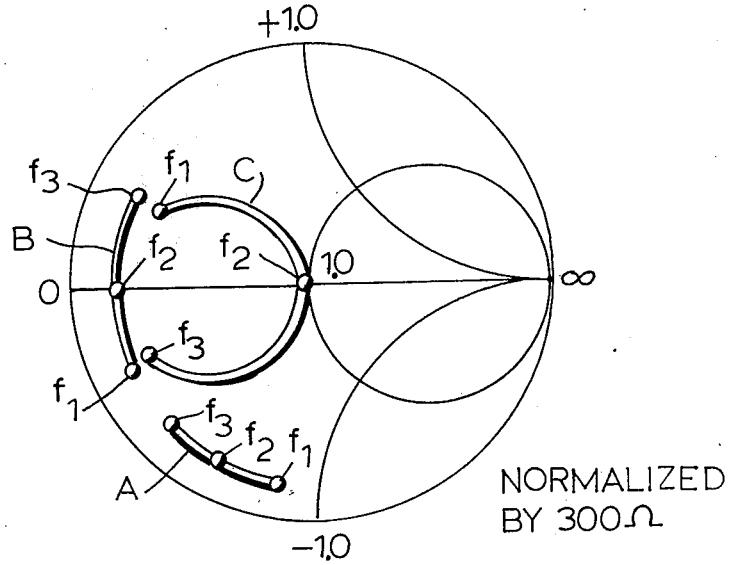
Figure 7A:
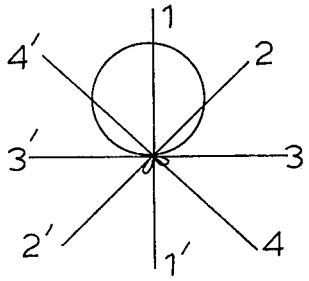
FIGS. 7-*a'* through -*k'* are views which are explanatory of the changeover modes of the same antenna unit and FIGS. 7-*a* through -*k* are views showing the directivity characteristics at each mode thereof.
Figure 7A:
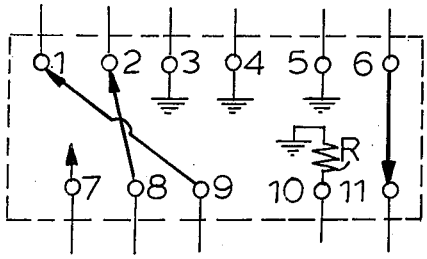
Figure 7B:
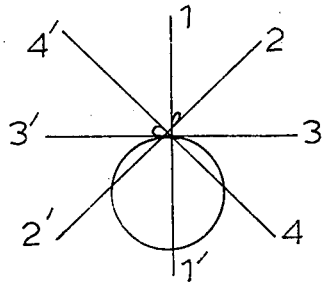
Figure 7B:
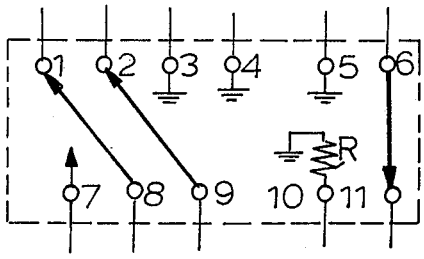
Figure 7C:
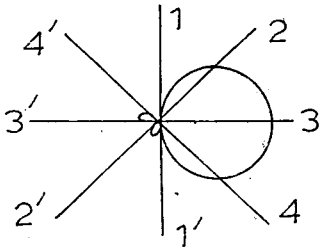
Figure 7C:
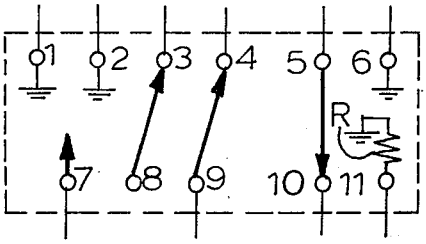
Figure 7D:
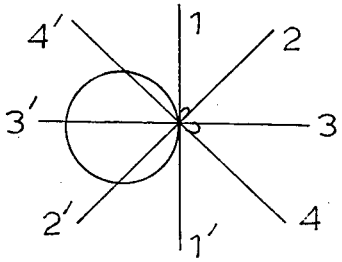
Figure 7D:
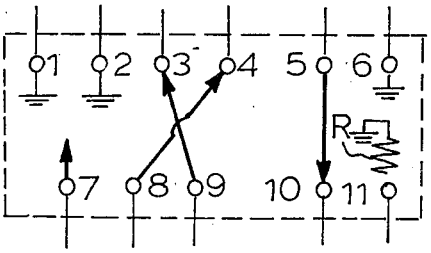
Figure 7E:
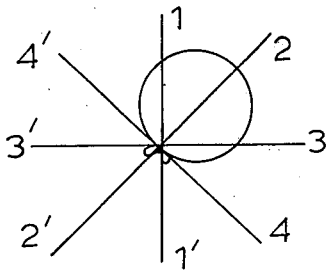
Figure 7E:
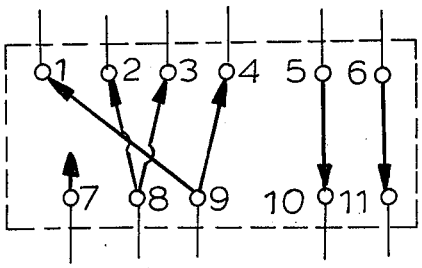
Figure 7F:
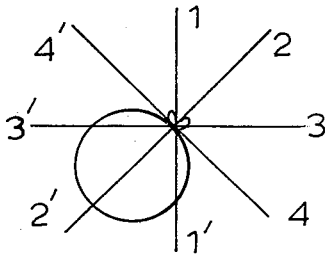
Figure 7F:
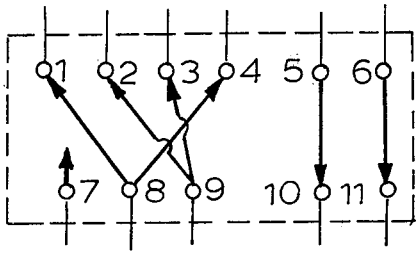
Figure 7G:
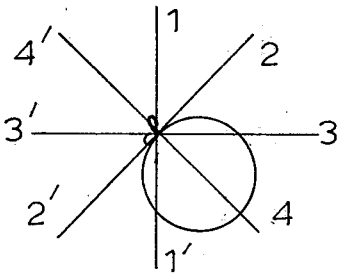
Figure 7G:
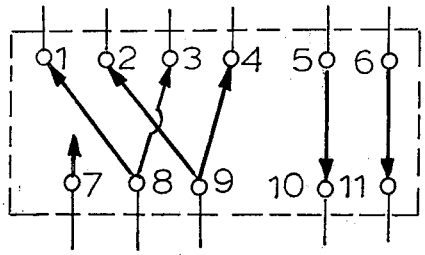
Figure 7H:
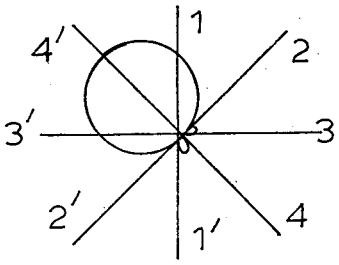
Figure 7H:
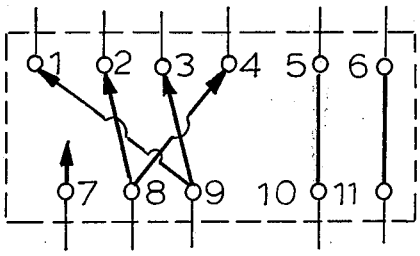
Figure 7I:
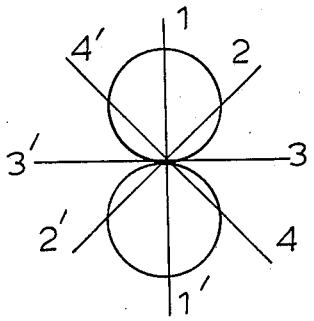
Figure 7I:
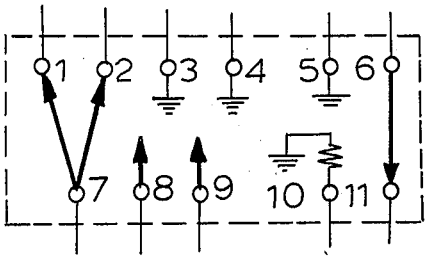
Figure 7J:
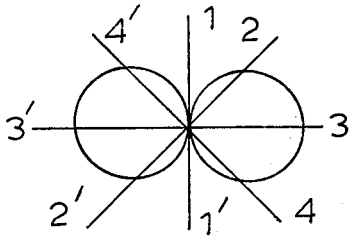
Figure 7J:
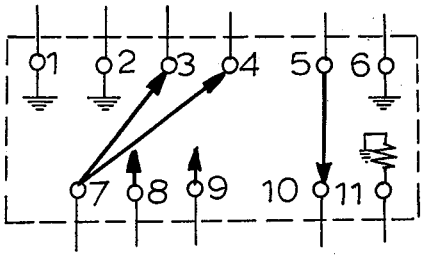
Figure 7K:
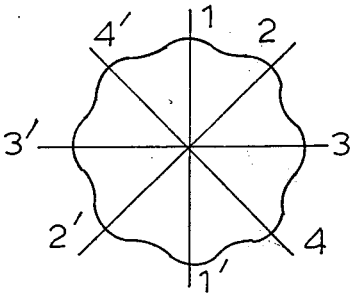
Figure 7K:
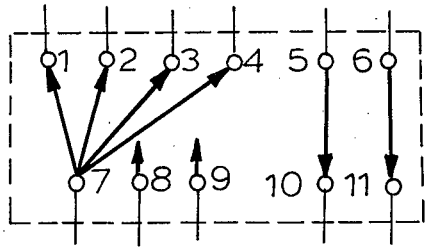

An embodiment of an antenna unit of the invention is shown in FIG. 2, in which reference numerals 8 and 9 designate first and second dipole antennas disposed opposite to each other at a regular interval; 10 and 11 designate third and fourth dipole antennas disposed opposite to each other at a regular interval; 12 designates a signal composer or combiner connected through coaxial cables 13*a* and 13*b* of equal length with respect to the first and second dipole antennas 8 and 9; 14 designates a signal composer or combiner connected through coaxial cables 15*a* and 15*b* of equal length with respect to the third and fourth dipole antennas 10 and 11; 16 designates a signal composer or combiner for composing signals from the signal composers 12 and 13; 17 designates a feed terminal of the unit 16; 18 designates tuning control means to variably control the tuning circuits of first through fourth dipole antennas 8 through 11, the tuning control means 18 being provided with a control signal source 19*a* for control signal V, a second control signal source 19*b* for control signal $V-\Delta V$, and a third signal source 19*c* for control signal $V+\Delta V$; and 20 designates changeover control means for feeding control signals from the first through third control signal sources 19*a* through 19*c* in various combinations to the first through fourth dipole antennas 8 through 11; the changeover control means includes changeover control unit 21 for controlling the connection relationship of the signal composer 16 with respect to the signal composers 12 and 14. The changeover control means 20 is connected at a first terminal thereof to the first dipole antenna 8, at a second terminal to the second dipole antenna 9, at a third terminal to the third dipole antenna 10, at a fourth terminal to the fourth dipole antenna, at a seventh terminal to the first control signal source 19*a*, at an eighth terminal to the second control signal source 19*b*, and at a ninth terminal to the control signal source 19*c*. The changeover control unit 21 is connected at a fifth terminal thereof to the signal composer 14, at a sixth terminal to the signal composer 12, at a tenth and an eleventh terminal to the signal composer 16. While, the first through fourth dipole antennas 8 through 11, as shown in FIG. 3 are disposed in the relationship such that the pair of dipole antennas 8 and 9 opposite to each other are perpendicular to the pair of dipole antennas 10 and 11.

Figure 4:
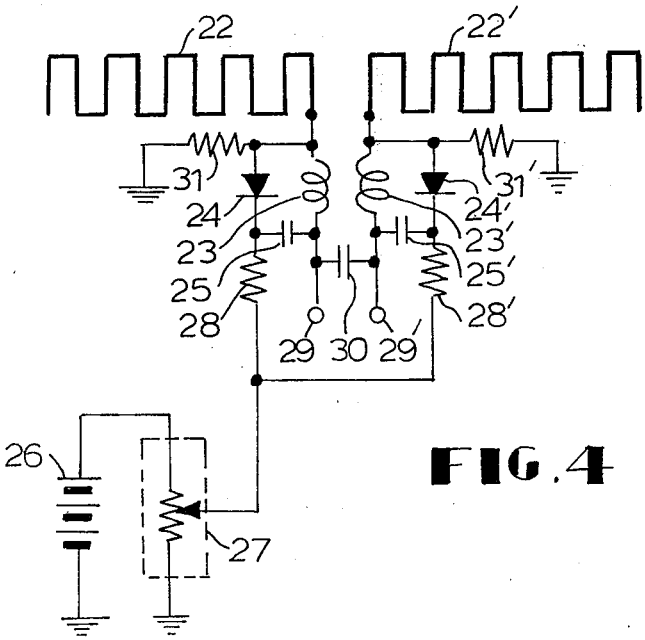
FIG. 4 is a circuit diagram of an example of a dipole antenna used in the antenna unit.

One of the four dipole antennas 8 through 11, is constructed as shown in FIG. 4. In detail, contraction type antenna elements 22 and 22' (hereinafter referred to merely as elements) having a distributed constant inductance are formed of a metallic foil, a metallic wire, or a conductor foil on a printed circuit board, and are formed of a metal having a low electric resistance value, such as copper, aluminum or iron. The elements 22 and 22' are formed in a pattern of being bent a required number of times at a required number of points, in each required direction, and at each required angle. The elements 22 and 22' are affected by their distributed inductance which is generated by bending the conductors and by continuously arranging the conductors alternately lengthwise of and perpendicularly to the elements, at each bending point, and between the respective bending points, thereby being equivalent to the conventional elements having added coils for cancelling the reactance of elements, as shown in FIGS. 1-*a* and -*b*. Hence, such elements 22 and 22' need not use the conventional concentrated constant coils. Furthermore, conductors having a wide surface area and of foil-like or thin-tubular shape are usable for fabricating the elements, thereby making it possible to considerably reduce losses. Consequently, the problem that conventional coils have very large losses to thereby lower radiation efficiency, can be solved, whereby it is possible to improve the actual gain and to materialize a small-sized antenna, and put such elements into full practice. The elements 22 and 22', which by themselves only tune in (are matched) only in a limited range of frequency, can be connected to a variable reactance circuit. The variable reactance circuit can employ a parallel resonance circuit or series resonance circuit. For example, the parallel resonance circuit, when in use, has a large reactance value at frequencies on both sides of resonance frequency fr, so that fr is properly set to enable the control of reactance component of the elements 22 and 22'. The element pattern is so designed that impedance of simple materials used for elements 22 and 22' at a frequency of from $f_1$ to $f_2$ to $f_3$ describes a curve A in FIG. 6. The elements 22 and 22' connect with parallel resonance circuits each comprising a coil 23, variable capacitor 24, capacitor 25, a coil 23', variable capacitor 24, and capacitor 25'. Resonance frequency is set at a required value, so that a positive reactance is obtained at a frequency of from $f_1$ to $f_2$ to $f_3$. Hence, the impedance trakcs on a curve B in FIG. 6. When interposing a capacitor 30 of a required value between feed terminals 29 and 29', an impedance of a required value describes a curve C in FIG. 6 to thereby obtain resonance at a frequency $f_2$. Hence, it is sufficient to change the values of variable capacitors 24 and 24', change the resonance frequency, and change the reactance component added to the elements 22 and 22', thereby meeting tuning conditions within all the bands of frequency from $f_1$ to $f_2$ to $f_3$.

The embodiment in FIG. 4 employs parallel resonance circuits. Alternatively, series resonance circuits may be used to provide the required reactance value, thereby of course obtaining the same tuning as the above. The capacitor value may of course be fixed if the inductance value of coil is variable.

Bias voltage for a variable capacitance diode used as the variable capacitors 24, 24' in FIG. 4, is supplied through high-frequency blocking resistances 28 and 28' with a variably divided voltage obtained from a D.C. voltage power supply 26 through a potentiometer 27. The capacitors are grounded at their other ends through high resistances 31 and 31'.

Figure 8:
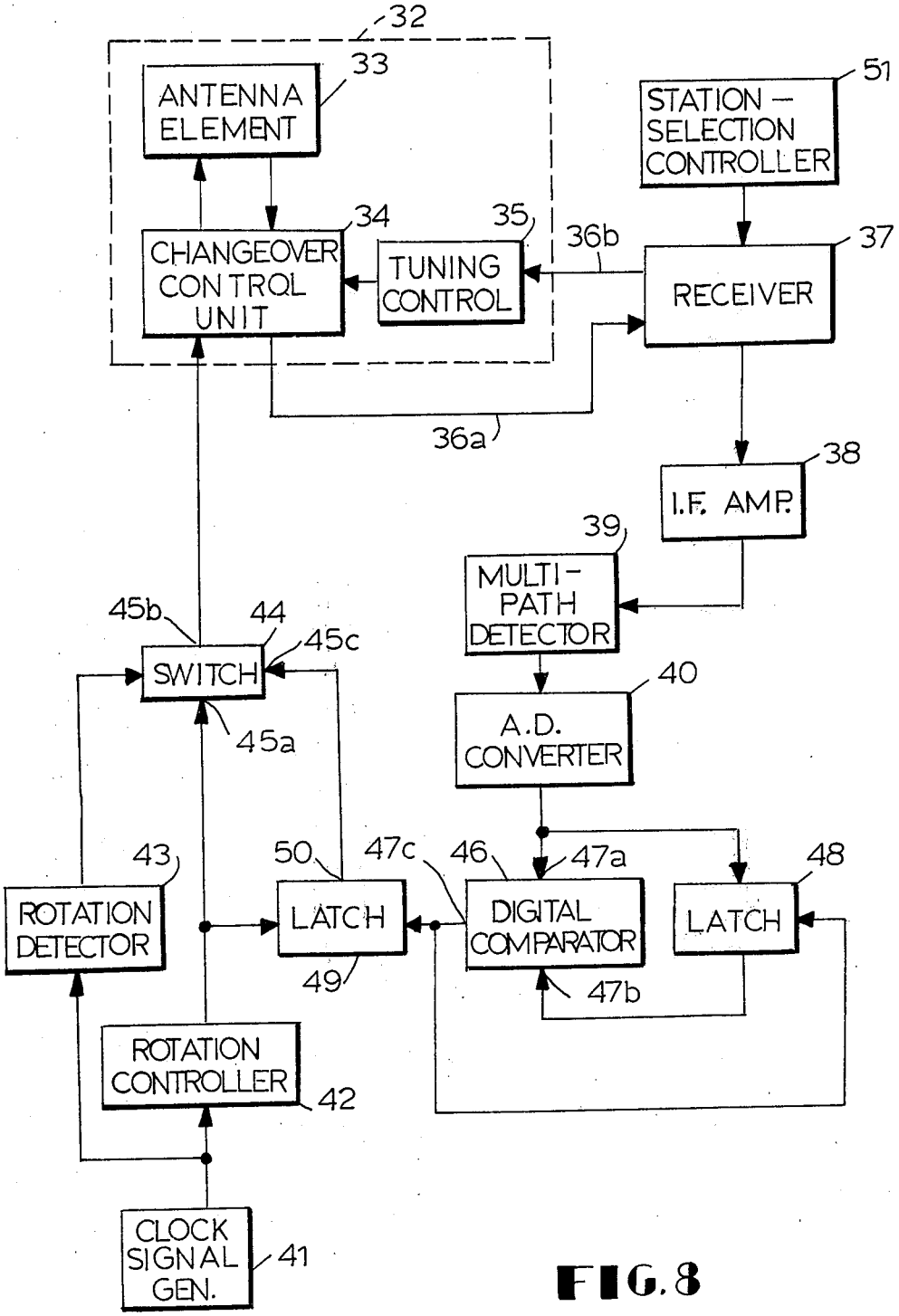
FIG. 8 is a view of system diagram of a receiving unit.

The antenna device constructed as above is directionally controllable of its directivity characteristics in four ways as shown in FIG. 7-*a* through -*d*, by changing over the changeover control means 20 and 21 as shown in FIGS. 7-*a'* through -*d'*. In this instance, matching resistance R is interposed at either the tenth terminal or eleventh terminal. The changeover control means 20 and 21 are changed over as shown in FIGS. 7-*e'* through -*h'* so as to enable four ways of directional control of the directivity characteristics. In other words, the directivity characteristic of phase difference feeding type antenna is directionally controllable in eight ways. The antenna device, as shown in FIGS. 7-*i'* and -*j'*, changes over the changeover control means 20 and 21, so that the directivity characteristic in a shape of a FIG. 8 is directionally controllable in two ways as shown in FIGS. 7-*i* and -*j*. The changeover control means 20 and 21 are changed over as shown in FIG. 7-*k'* to make it possible to form a nearly omnidirectional antenna as shown in FIG. 7-*k*.

FIG. 8 is a block diagram of a receiving system of the present invention, in which reference numeral 32 designates the aforesaid antenna unit shown in FIG. 2, the antenna unit 32 comprising; an antenna element constitution unit 32 including dipole antennas 8 through 11 and signal composers 12 and 14; changeover control unit 34 including the changeover control means 20 and 21 and signal composer 16; and tuning control unit 35 for tuning control means 18 including the control signal sources 19*a* through 19*c*.

The feed terminal 17 of signal composer 16 within the changeover control unit 34 is connected to an antenna terminal at the receiver through coaxial cable 36*a*, thereby feeding a receiving signal into the receiver. Station-selection of receiver 37 is desirably controlled by an output signal from a station-selection controller 51. The receiver 37 is associated in receiving frequency with the antenna unit 32 by means of control voltage V changeable in association by way of tuning control line 36*b*. An intermediate-frequency signal picked up from a fully wide dynamic range portion of an intermediate-frequency amplifier within the receiver 37 is supplied to an intermediate-frequency amplifier 38 of fully wide dynamic range so as to amplify the picked-up intermediate-frequency signal to a required level, and the amplified signal is further supplied to a multipath detector 39 which converts into a d.c. voltage value the amount of multipath influence included in the amplified signal, so that an analog voltage corresponding to the d.c. signal is supplied to an analog-digital converter 40 (hereinafter referred to A/D converter) and converted into a digital value, the input and output of the A/D converter 40 having a proportional relationship therebetween.

On the other hand, the directivity rotation control of antenna unit 32 is carried out by a changeover control signal from a rotation controller 42 used for converting a clock signal from a clock signal generator 41 into a directivity changeover control signal. The clock signal from the clock signal generator 41 is simultaneously fed into a rotation detector 43 which detects the rotation of direction of antenna unit 32 at a required angle. The output of the rotation detector 43 sets the changeover line of line changeover switch 44 so that one input terminal 45*a* at the switch 44 is connected to an output terminal 45*b* until the antenna ends its rotation. Then, after the antenna rotation reaches its required angle, the changeover line of line changeover switch 44 sets the other input terminal 45*c* to be connected to the output terminal 45*b*.

An output digital signal of the A/D converter 40 is fed into one comparison input terminal 47*a* of a digital comparator 46, and when digital signals fed into the comparison input terminals 47*a* and 47*b* are compared, so that, for example, a digital signal fed into the comparison input terminal 47*a* is judged to be smaller than the digital signal fed into the comparison input terminal 47*b*, an output, which is stored in a first latch 48 used to temporarily store the digital signal at the comparison input terminal 47 through the comparison output terminal 47*c* and an output signal "1", is fed into the other comparison input terminal 47*b* of the digital comparator. On the other hand, a second latch 49 is provided to temporarily store the changeover control signal generated by the rotation controller 42 just when the signal "1" output to the comparison output terminal 47*c* of digital comparator 46. The changeover control signal temporarily stored by the second latch 49 is supplied from an output terminal 50 thereof to the other input terminal 45*c* of the line changeover switch 44.

The line changeover switch 44, as aforesaid, connects its input terminal 45*a* to its output terminal 45*b* until antenna unit 37 ends its rotation at a required angle, and, after rotation to the required angle, connects its input terminal 45*c* to the output terminal 45*b*. Hence, after rotation to the required angle, the changeover controller 34 is fed with a changeover signal stored temporarily in the second latch 49, whereby the antenna unit 32 is set in a specific direction according to said signal.

The sequential comparison unit comprising the digital comparator 46 and first latch 48 functions to sequentially compare a digital signal fed into the input terminal 47*a* with a digital signal fed into the input terminal 47*b* through a digital signal which is the smallest signal among the digital signals fed into the input terminal 47*a* prior to the comparison and which is stored temporarily in the first latch 48. Hence, the first latch always temporarily stores therein the smallest digital signal prior to the comparison time, resulting in the first latch 48 lastly storing therein the smallest digital signal while the directivity of antenna 32 is rotating to a required angle. Simultaneously, the comparison output terminal 47*c* at the digital comparator 46 leads to output the signal "1" at the time when the smallest digital signal is supplied to the input terminal 47*a*. Consequently, the second latch 49 lastly stores the rotation control signal when the smallest digital signal is fed into the input terminal 47*a* of the digital comparator 46. As a result, the antenna unit 32 is automatically set to orient itself in the direction of minimizing the amount of multipath influence included in an input signal fed to the antenna terminal of receiver 37.

In this instance, the directivity in FIGS. 7-*a* through -*k* and the rotation control signal applied to the changeover control unit 34 are of course set previously in independent combinations in accordance with each other. The switching of changeover control unit 34 by the rotation control signal, of course, employs a simple relay switch for switching terminals 1 to 4 and 7 to 9 in FIG. 7, and coaxial relay switches switching terminals 5, 6 and 10, 11 and matching resistance R.

Receiver 37 may be a digital control station-selection receiver of a closed loop block system type using PLL synthesizer, or of an open block system type using a D/A converter. An electronic tuning receiver using d.c. voltage as its station-selection control signal, or a variable capacitor system receiver outputting a d.c. voltage signal which is changed correspondingly to a rotary angle, is of course also applicable. Needless to say, it is of great practical value that at every station-selection changeover, by operating the station selection controller 51, each unit is reset in its previous condition so that the clock generator 41 again starts the clock generation (not shown), whereby the antenna unit 32 direction is automatically set so that the receiver 37 is supplied with an antenna input always including the minimum multipath influence corresponding to each station selection. In this instance, the multipath detector 39 can use the detecting system for detecting the amplitude modulation component by multipath and of intermediate-frequency signal, for example, in a level zone free from a limiter, thereby detecting it as a d.c. voltage output.

Figure 9:
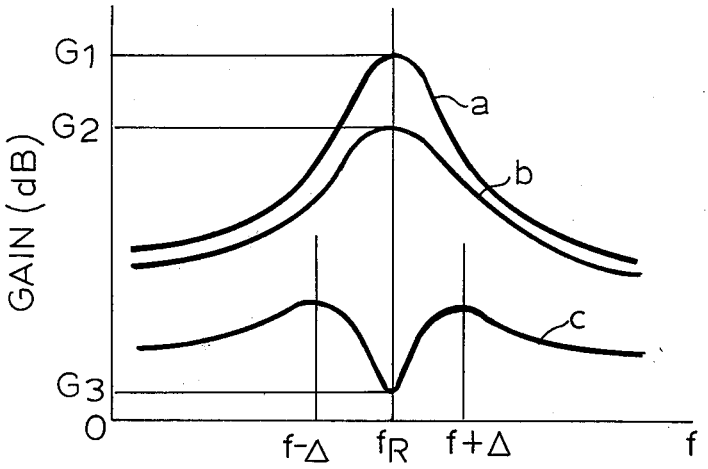
FIG. 9 shows the frequency to gain characteristics of the antenna unit.

The frequency to gain characteristics in FIGS. 7-*a* through -*h* are represented by curves b and c in FIG. 9 and those in FIGS. 7-*i* through -*j*, by a curve a in FIG. 9.

Figure 11:
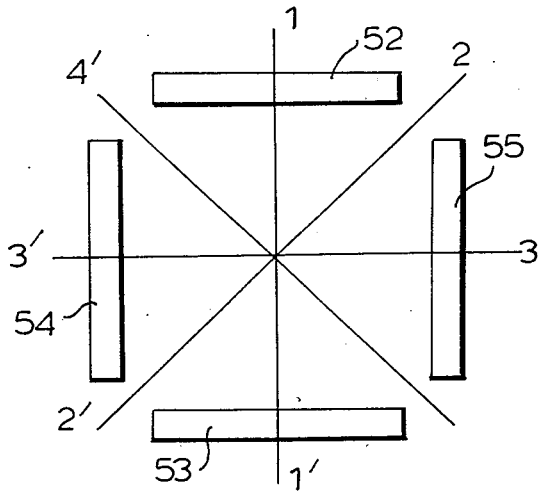
FIG. 11 is a view explanatory of the arrangement of the antenna elements at the antenna unit.
Figure 10:
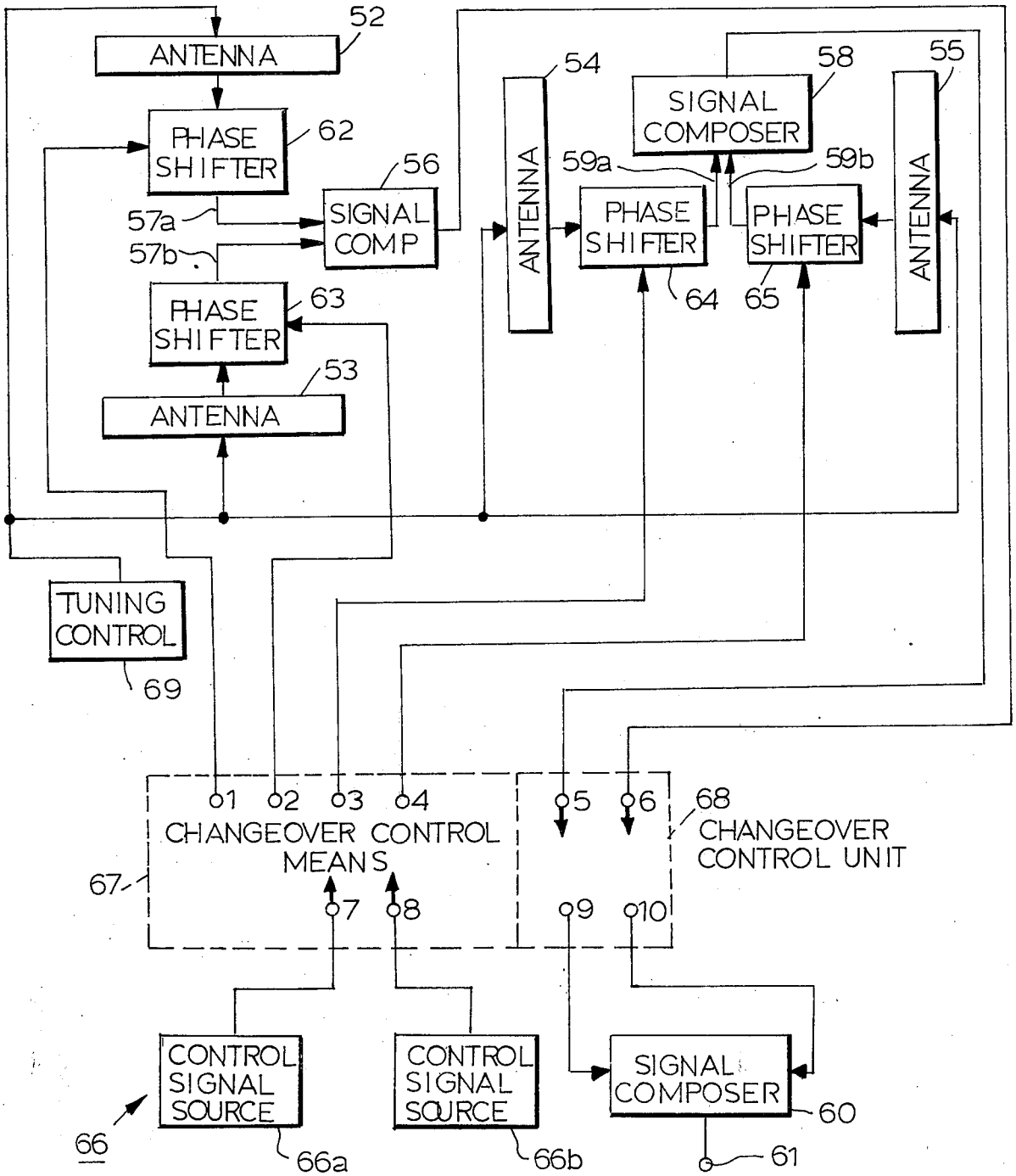
FIG. 10 is a block diagram of a modified embodiment of an antenna unit of the present invention.

FIGS. 10 to 12 are views explanatory of a modified embodiment of the present invention.

FIG. 10 shows a modified embodiment of the antenna unit, in which; reference numerals 52 and 53 designate first and second dipole antennas disposed opposite to each other at a regular interval d; reference numerals 54 and 55 designate third and fourth dipole antennas disposed opposite to each other at a regular interval d; reference numeral 56 designates a signal composer connected to the first and second dipole antennas 52 and 53 by way of coaxial cables 57*a* and 57*b*; 58 designates a signal composer connected to the third and fourth dipole antennas 54 and 55 by way of coaxial cables 59*a* and 59*b* of equal length; reference numeral 60 designates a signal composer for composing signals from the signal composers 56 and 58; reference numeral 61 designates a feed terminal of the signal composer 60; reference numeral 69 designates a tuning control means for variably controlling the tuning circuits of the first to fourth dipole antennas 52 to 55; reference numerals 62 and 63 designate first and second phase shifters interposed at desired intermediate portions along the coaxial cables 57*a* and 57*b* of equal length respectively; reference numerals 64 and 65 designate third and fourth phase shifters interposed at desired intermediate portions along the coaxial cables 59*a* and 59*b* of equal length respectively; reference numeral 66 designates a control means for variably controlling the first to fourth phase shifters 62 to 65, the control means having a first control signal source 66*a* of signal "0" and a second signal source 66*b* of signal "1"; reference numeral 67 designates a changeover control means for transferring control signals from the first and second control signal sources 66*a* and 66*b* constituting the control means 66 to the first to fourth phase shifters 62, 63, 64 and 65 in various combinations with respect thereto, the changeover control means 67 including a changeover control unit 68 for controlling a connecting relationship of the signal composer 60 with the signal composers 56 and 58. The changeover control means 67 is connected from its first terminal to the first phase shifter 62, from its second terminal to the second phase shifter 63, from its third terminal to the third phase shifter 64, from the fourth terminal to the fourth phase shifter 65, from its seventh terminal to the first control signal source 66*a*, and from the eighth terminal to the control signal source 66*b*. The changeover control unit 68 is connected from its fifth terminal to the signal composer 58, from the sixth terminal to the signal composer 56, and from the tenth and eleventh terminals to the signal composer 60. The first to fourth dipole antennas 52 to 55, as shown in FIG. 3, are arranged so that the pair of dipole antennas 52 and 53 are perpendicular to the pair of antennas 54 and 55.

The first, second, third and fourth phase shifters 62, 63, 64 and 65 in FIG. 10 have a zero phase shift when the changeover control means 67 provides a signal "0" from the first control signal source 66*a* in the control means 66. When a signal "1" from the second control signal source 66*b* is provided, a phase shift $-\psi$ is effected which is equal to the space propagation phase shift $-\psi$ of a radio wave at the interval d between the opposite dipole antennas 52 and 53 and between those 54 and 55.

Figure 12A:
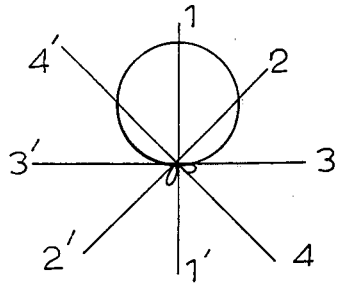
FIGS. 12-*a'* through -*p'* are views explanatory of changeover modes of the same antenna unit and FIGS. 12-*a'* through -*p* are views showing the directivity characteristics at each mode thereof.
Figure 12A:
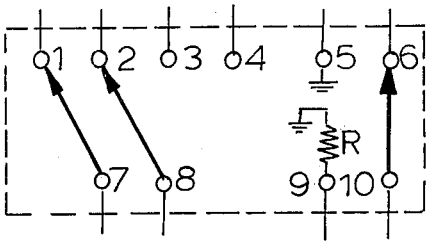
Figure 12B:
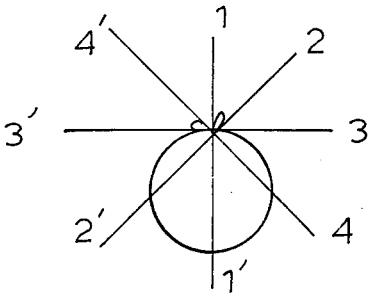
Figure 12B:
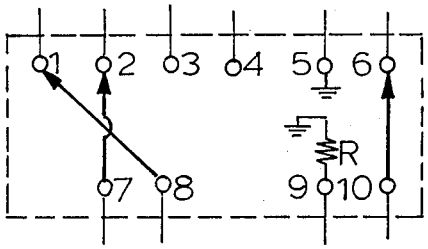
Figure 12C:
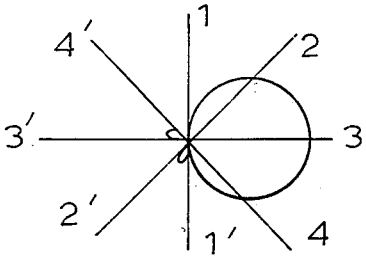
Figure 12C:
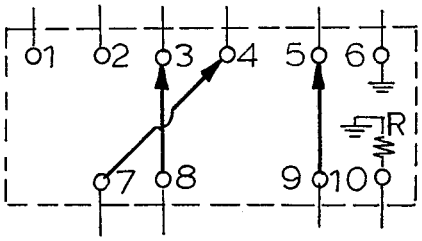
Figure 12D:
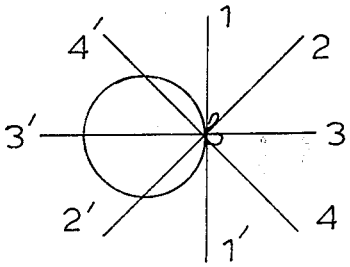
Figure 12D:
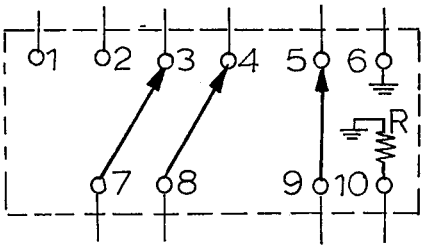
Figure 12E:
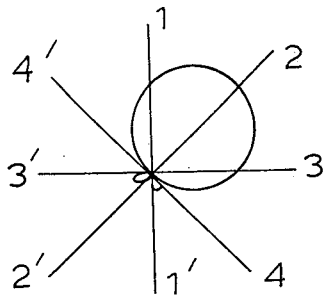
Figure 12E:
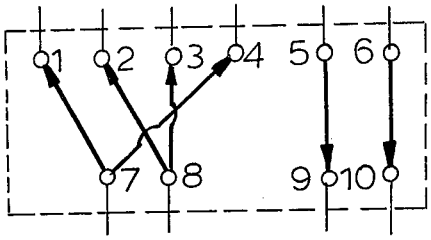
Figure 12F:
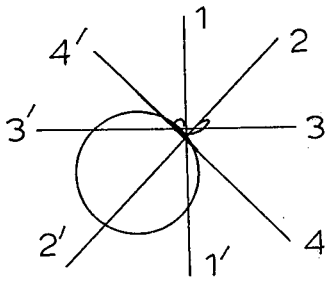
Figure 12F:
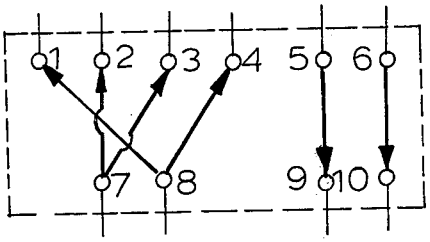
Figure 12G:
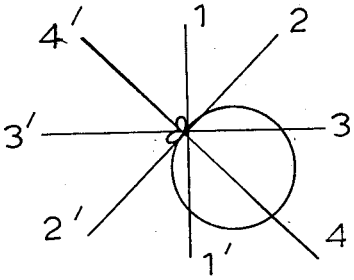
Figure 12G:
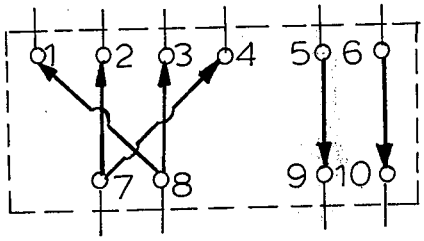
Figure 12H:
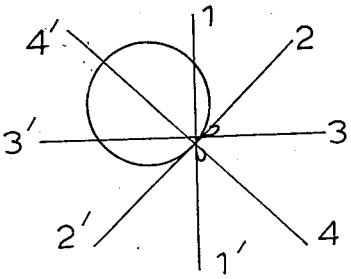
Figure 12H:
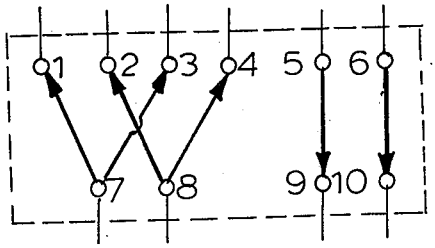
Figure 12I:
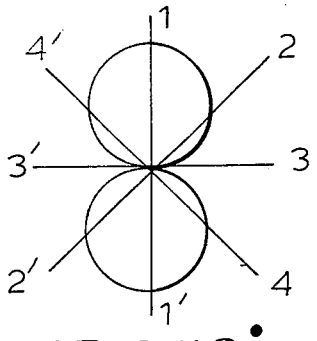
Figure 12I:
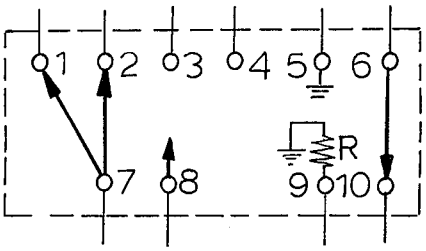
Figure 12J:
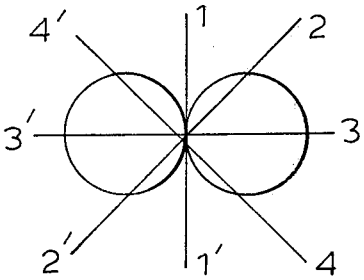
Figure 12J:
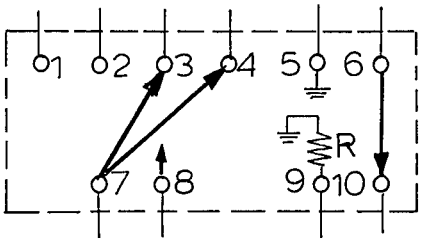
Figure 12K:
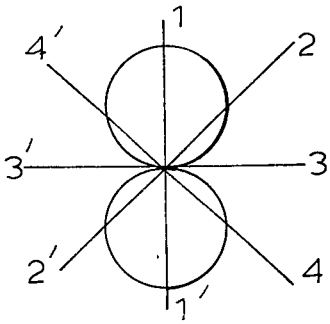
Figure 12K:
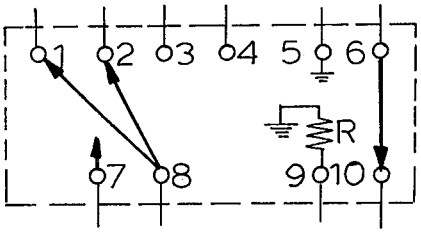
Figure 12L:
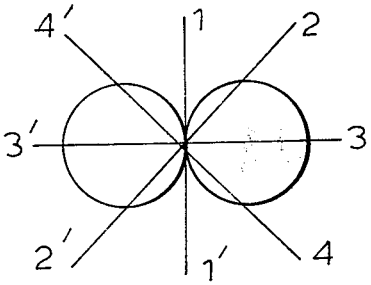
Figure 12L:
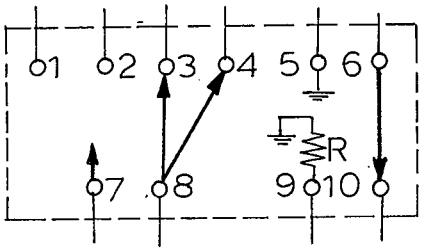
Figure 12M:
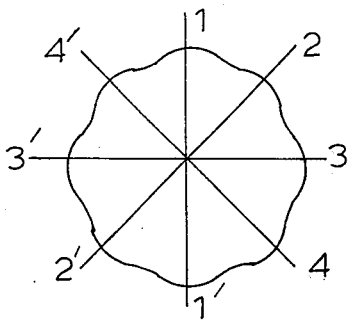
Figure 12M:
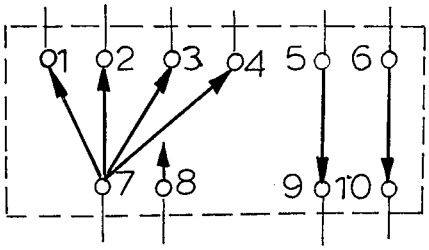
Figure 12N:
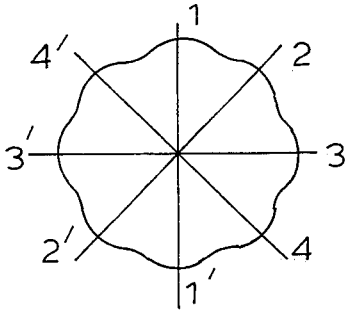
Figure 12N:
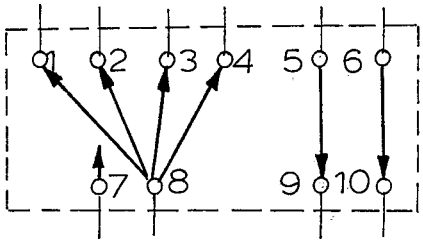
Figure 12O:
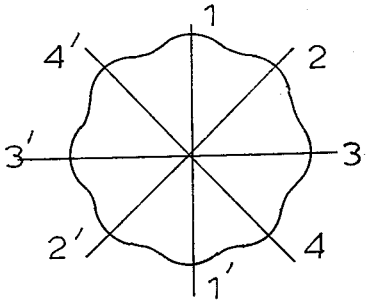
Figure 12O:
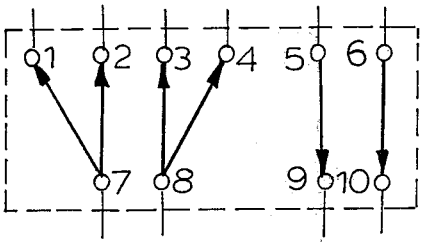
Figure 12P:
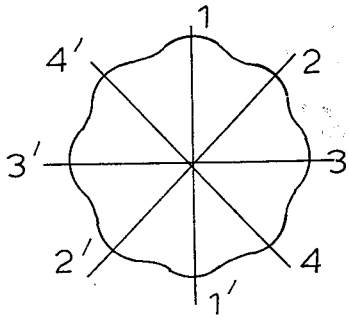
Figure 12P:
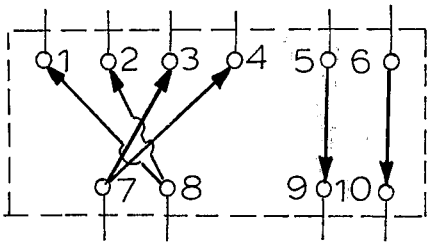

In the antenna device constructed as above, changeover means 67 and 68 are changed over as shown in FIGS. 12*a'* to *d'*, so that the directivity characteristic is directionally controllable in four ways as shown in FIGS. 12-*a* to -*d*, where a matching resistance R is interposed at either terminal 9 or 10. The changeover of changeover control means 67 and 68 as shown in FIGS. 12-*e'* to *h'* enables four ways of directional control of the directivity characteristic. Namely, the directivity characteristic of phase difference feed type antenna is directionally controllable in eight ways. The antenna device changes over the changeover control means 67 and 68 as shown in FIGS. 12-*i'* to -*l'* to thereby enable control of directivity characteristic like the figure of 8 in two ways as shown in FIGS. 12-*i* to -*l*. The changeover of changeover control means 67 and 68 as shown in FIGS. 12-*m'* to -*p'* can produce a nearly unidirectional antenna as shown in FIGS. 12-*m* to 12-*p*.

Figure 14:
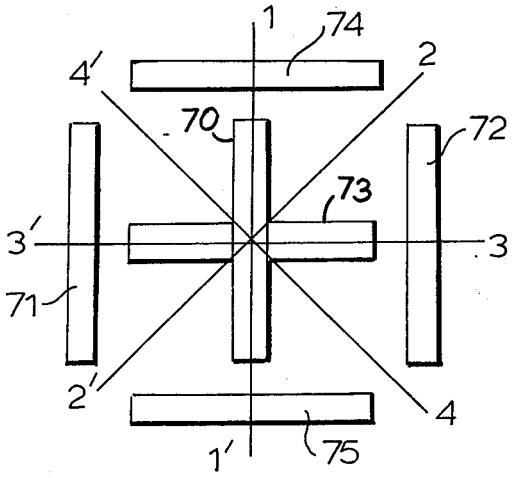
FIG. 14 is a view explanatory of the arrangement of the antenna elements at the antenna unit.
Figure 13:
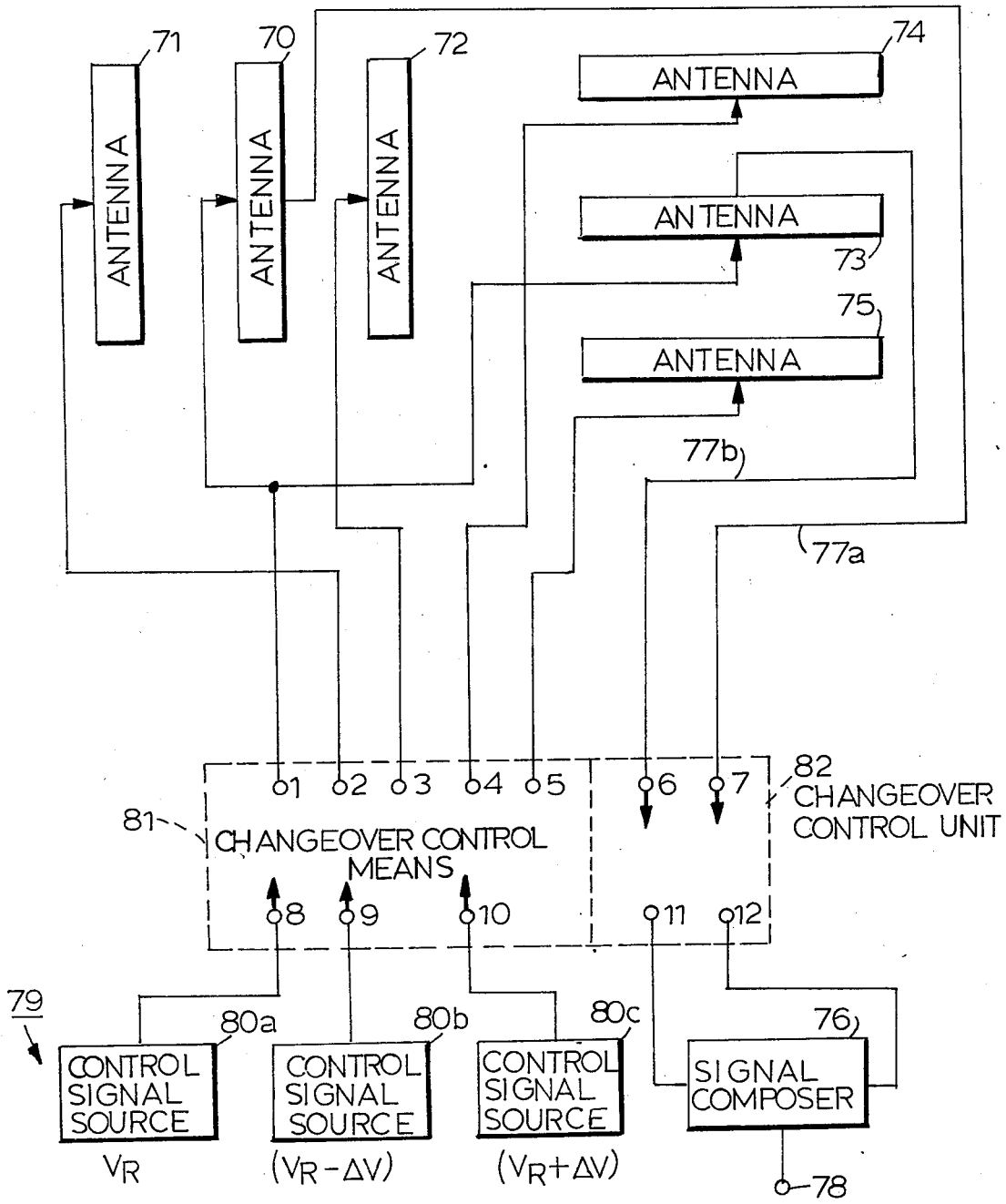
FIG. 13 is a block diagram of another modified embodiment of an antenna unit of the present invention.
Figure 15A:
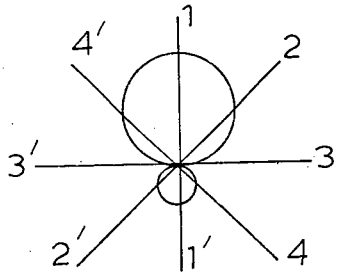
FIGS. 15-*a'* through -*k'* are views explanatory of the changeover modes of the same antenna unit and FIGS. 15-*a* through -*k* are views explanatory of the directivity characteristics at each mode thereof.
Figure 15A:
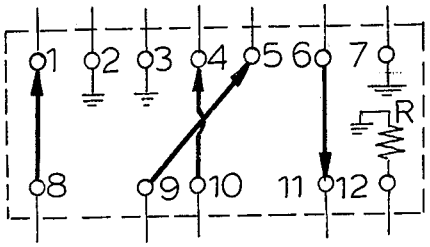
Figure 15B:
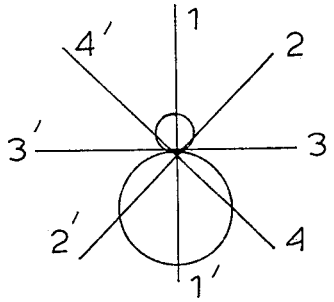
Figure 15B:
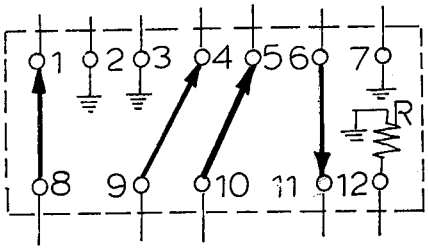
Figure 15C:
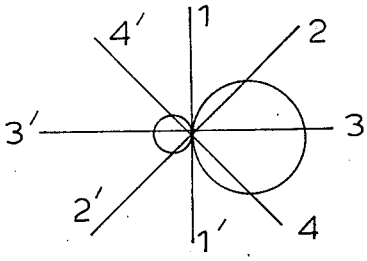
Figure 15C:
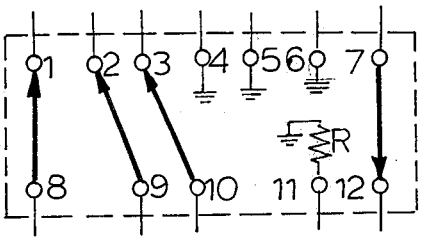
Figure 15D:
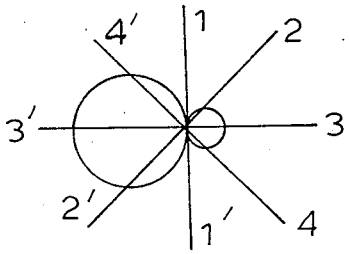
Figure 15D:
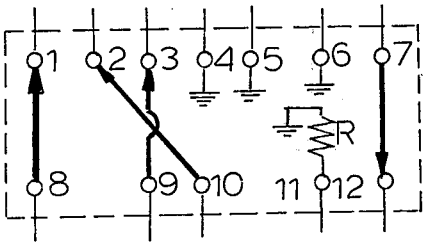
Figure 15E:
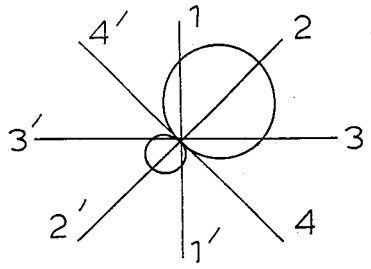
Figure 15E:
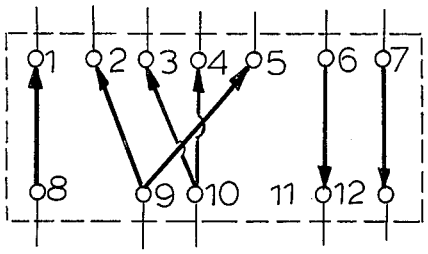
Figure 15F:
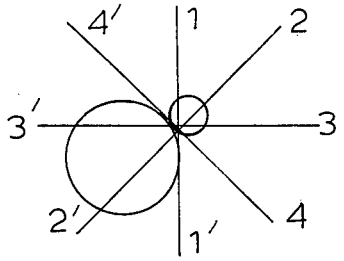
Figure 15F:
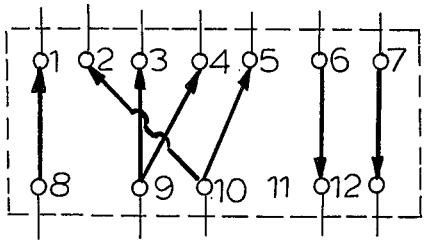
Figure 15G:
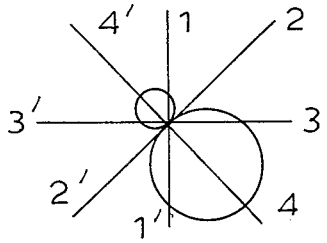
Figure 15G:
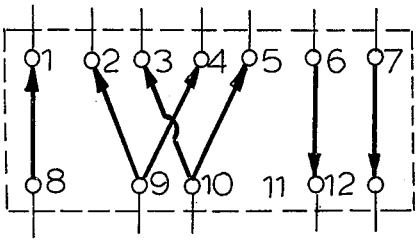
Figure 15H:
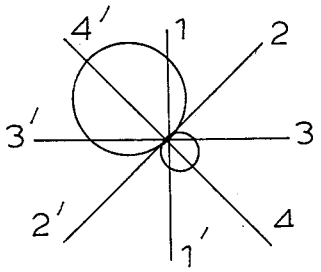
Figure 15H:
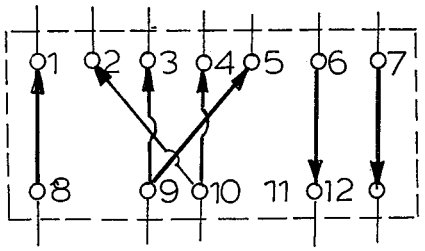
Figure 15I:
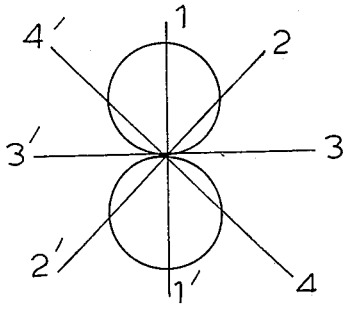
Figure 15I:
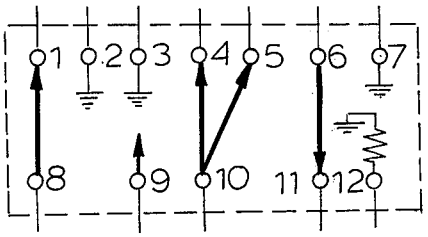
Figure 15J:
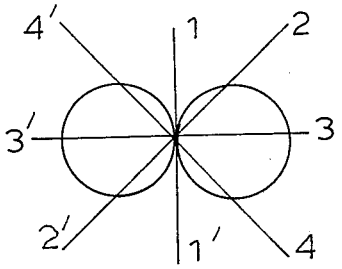
Figure 15J:
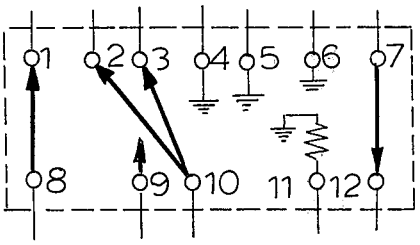
Figure 15K:
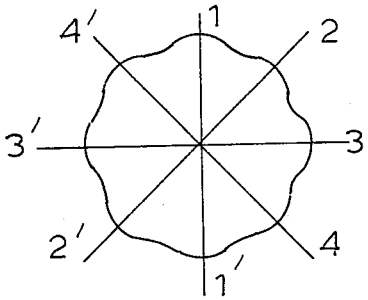
Figure 15K:
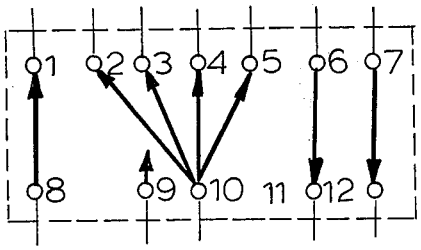

FIGS. 13 through 15 are views explanatory of another modified embodiment of the present invention.

Another modified embodiment of the antenna unit is shown in FIG. 13, in which reference numerals 70, 71 and 72 designate a first dipole antenna used for a radiator, and a third and fourth dipole antenna respectively used for wave guides and/or reflectors, these dipole antennas being disposed opposite to each other at regular intervals; reference numerals 73, 74 and 75 designate a second dipole antenna used for a radiator, and fifth and sixth dipole antennas respectively used for wave guides and/or reflectors, the dipole antennas 73, 74 and 75 being disposed opposite to each other at regular intervals; reference numeral 76 designates a signal composer connected with respect to the first and second dipole antennas 70 and 73 used for radiators through coaxial cables 77*a* and 77*b* of equal length; reference numeral 78 designates a feed terminal of the signal composer 76; reference numeral 79 designates tuning control means for variable-controlling tuning circuits of the first to sixth dipole antennas 70 to 75, the tuning control means 79 being provided with a first control signal source 80*a* of signal $V_R$, a second control signal source 80*b* of signal $V_R-\Delta V$, and third control signal source 80*c* of signal $V_R+\Delta V$; and reference numeral 81 designates a changeover control means for applying to the first through sixth dipole antennas 70 through 75 control signals in various combinations from the first to third control signal sources 80*a* to 80*c* constituting the tuning control means, the changeover control means 81 including a changeover control unit 82 for controlling the connection relationship of the signal composer 76 with respect to the feed terminal paths of the first and second dipole antennas used for radiators. The changeover control means 81 is connected from its first terminal to the first and second dipole antennas 70 and 73, from its second terminal to the third dipole antenna 71, from its third terminal to the fourth dipole antenna 72, from its fourth terminal to the fifth dipole antenna 74, from its fifth terminal to the sixth dipole antenna 75, from its eighth terminal to the first control signal source 80*a*, from its ninth terminal to the second control signal source 80*b*, and from its tenth terminal to the third control signal source 80*c*. The changeover control unit 82 is connected from its sixth terminal to the second dipole antenna 73, from its seventh terminal to the first dipole antenna 70, and from its eleventh and twelfth terminals to the signal composer 76. The first through sixth dipole antennas, as shown in FIG. 14, consist of one set of opposite dipole antennas 70, 71 and 72 and another set of opposite dipole antennas 73, 74 and 75 which are disposed perpendicular to the first set of antennas.

In the antenna device constructed as foregoing, the changeover control means 81 and 82 are changed over as shown in FIGS. 15-*a'* to *d'* thereby complete four ways of directional control of the directivity characteristic as shown in FIGS. 15-*a* to -*d*, in which a matching resistance R is interposed at either the eleventh or twelfth terminal. Changeover of the changeover control means 81 and 82 as shown in FIGS. 15-*e'* to -*h'* enables four ways of directional control of the directivity characteristic as shown in FIGS. 15-*e* to -*h*. In other words, the directivity characteristic of a three-element Yagi antenna is controllable in eight ways. The antenna device is directionally controllable in two ways of its directivity characteristic in a shape of the figure 8 as shown in FIGS. 15-*i* to -*j*, by changing over the changeover control means 81 and 82 as shown in FIGS. 15-*i'* to -*j'*, in which a matching resistance R is interposed at either the eleventh or twelfth terminal. The changeover control means 81 and 82 are changed over as shown in FIG. 15-*k'* to thereby make the antenna nearly unidirectional as shown in FIG. 15-*k*.

In the aforesaid description, two sets of three element antennas are used, but even the when non-feed elements at both sides of the radiator become two or more respectively, this invention is applicable, where good performance is obtainable when the interval between the elements is kept in the range of from 0.1λ to 0.4λ.

Figure 16:
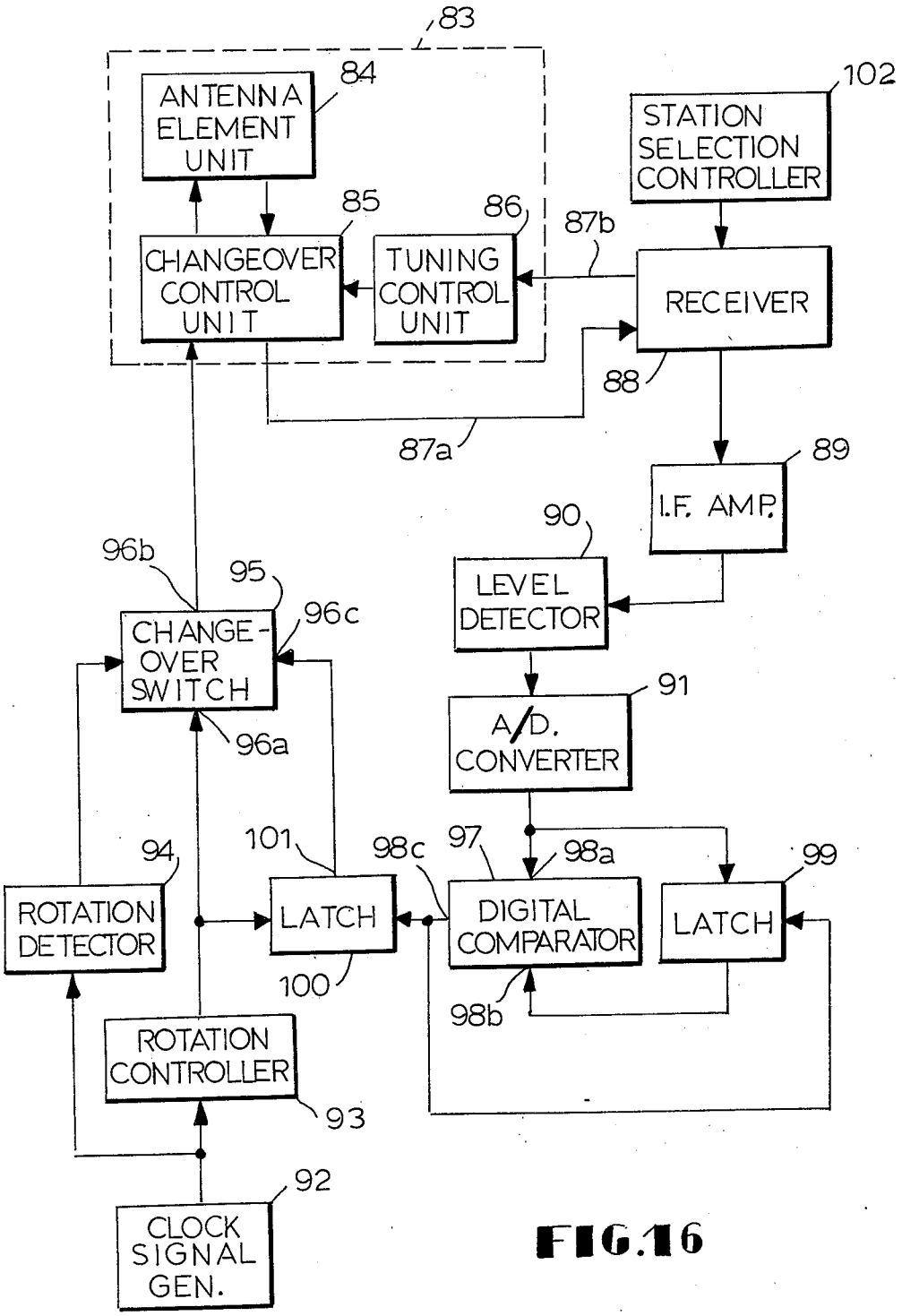
FIG. 16 is a block diagram of an additional embodiment of an antenna system of the present invention.

FIG. 16 is a view explanatory of a further modified embodiment of the present invention, showing a block diagram of its directivity control antenna system. In the drawing, reference numeral 83 designates the aforesaid antenna unit comprising an antenna element constituting unit 84 including dipole antennas 8 through 11 and signal composers 12 and 14, a changeover control unit 85 including changeover control means 20 and 21 and a signal composer 16, and a tuning control unit 86 for tuning control means 18 including control signal sources 19*a* through 19*c*. The feed terminal at signal composer 16 in the changeover control unit 85 is connected to the antenna terminal of a receiver 88 through a coaxial cable 87*a* so that receiving signal is fed into the receiver. Output of station selection controller 102 desirably controls the station-selection of receiver 88. The receiver 88 is associated in receiving frequency with the antenna unit 83 by a control voltage V changeable in association through a tuning control line 87*b*. An intermediate-frequency signal picked up from a fully wide portion in the dynamic range of the intermediate-frequency amplifier within the receiver 88 is supplied to an intermediate-frequency amplifier 89 to amplify the signal up to a required level. The amplified signal is further supplied to a level detector 90 which converts the amplitude of intermediate-frequency signal into a d.c. voltage level. The analog d.c. signal level is fed to an analog-digital converter (hereinafter referred to as an A/D converter) to be converted into a digital value, where the input and output of the A/D converter is assumed to be in a proportional relationship. On the other hand, rotational control of the directivity of antenna unit 83 is controlled by the changeover control signal output from a rotation controller 93 which converts a clock signal from clock signal generator 92 into a directivity changeover control signal. The clock signal from the clock signal generator 92 is simultaneously supplied to a rotation detector 94 which detects the rotation of the antenna directivity pattern at a required angle. Until the directivity pattern ends its rotation at a required angle, a changeover line of line changeover switch 95 is set to connect one input terminal 96*a* with an output terminal 96*b*, so that rotation detector 94 operates. After the finish of the rotation of the directivity pattern at the required angle, the changeover line of line switch 95 is set to connect the other input terminal 96*c* to the output terminal 96*b*, so that the rotation detector 94 works. The output digital signal of A/D converter 97 is fed into one comparison input terminal 98*a*. The other comparison input terminal 98*b* is supplied with the output stored in a first latch 99 which operates to temporarily store a digital signal at the comparison input terminal 98*a* by means of signal "1" output to the comparison input terminal 98*c* when digital signals fed into the comparison input terminals 98*a* and 98*b* are compared to be so judged that, for example, the digital signal fed into the comparison input terminal 98*a* is larger than that fed into the comparison input terminal 98*b*. A second latch 100 is provided so as to temporarily store a changeover control signal being, at that time, generated by the rotation controller 93 through the signal "1" output from the comparison output terminal 98*c* of the digital comparator 97. The changeover control signal stored in the second latch 100 is supplied from its output terminal 101 to the other input terminal 96*c* of line switch 95. The line changeover switch 95, as noted above, connects its input terminal 96*a* with output terminal 96*b* up to the finish of rotation of antenna unit 93 at the required angle, and after the finish of the rotation, connects the input terminal 96*c* with output terminal 96*b*, whereby, after the finish of the rotation, the changeover control signal temporarily stored in the second latch 100 is supplied to the changeover controller 85, thereby setting the directivity of antenna unit 83 to orient the antenna pattern in the direction of the signal. In this instance, a sequential comparison unit comprising digital comparator 97 and first latch 99 sequentially compares the digital signal fed into input terminal 98*a* with the digital signal fed into input terminal 98*b*, which is the largest of the digital signals fed into the input terminal 98*a* prior to the time of comparison and temporarily stored in the first latch 99. Hence, the first latch 99 always temporarily stores the largest digital signal before the comparison, whereby the first latch 99 at last stores the largest digital signal while the directivity of antenna unit 83 rotates to the required angle. At the same time, the second latch 100 at last stores the rotation control signal when the largest digital signal is fed into the input terminal 98*a* at digital converter 97. As a result, the antenna unit 83 is automatically set to orient the directivity pattern in the direction of maximizing the input signal supplied to the antenna terminal of receiver 88.

The directivity patterns in FIGS. 7-*a* through -*k* and rotation control signals applied to changeover control unit 85, of course, have previously been set in condition of independent combination in accordance with each other. Switching of the changeover control unit 85 by rotation control signal of course uses a simple relay switch for switching terminals 1 to 4 and 7 to 9 in FIG. 7, and a coaxial relay switch for terminals 5 and 6, and 10 and 11, and matching resistance R.

Needless to say, the receiver 88 may be a digital control station selection receiver of the closed loop block system type using a PLL synthesizer or may be an open loop block system type using a D/A converter. An electronic tuning receiver using a d.c. voltage as the station selection control signal is applicable, or a variable-capacitor system type receiver which outputs a d.c. voltage signal changed correspondingly to the pattern rotation angles. Needless to say, the selection controller 92 operates to reset each unit to its former conditions at every selection-changeover so that the clock signal generator 92 again starts the clock signal generation (not shown), whereby the directivity of the antenna unit 83 is automatically set to feed a maximum antenna input signal into the receiver, thus increasing its practical value.

FIGS. 17 through 25 are views explanatory of an antenna device of the present invention, which is provided with at least two antenna elements disposed opposite to each other at a regular interval.

Figure 17:
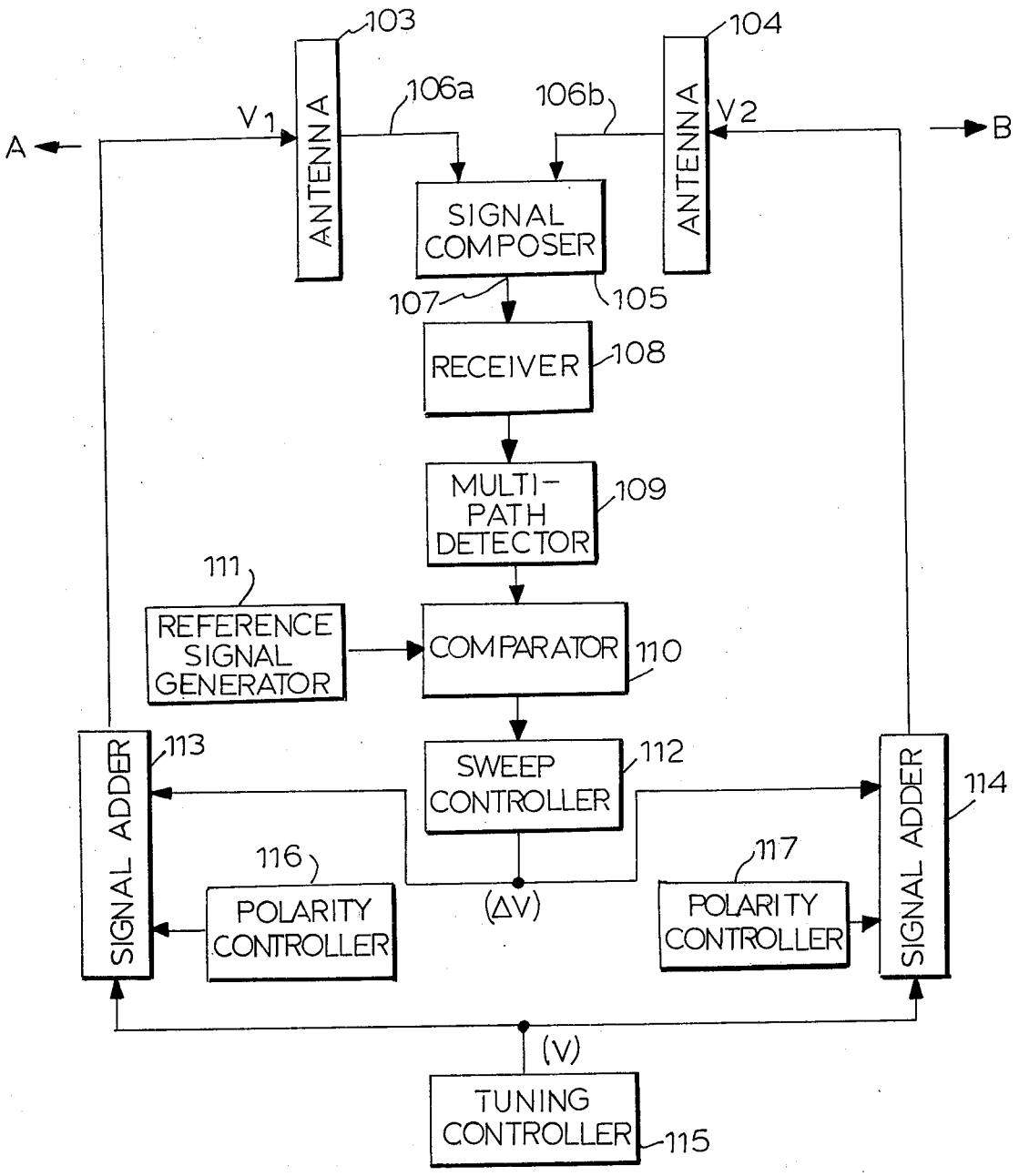
FIG. 17 is a block diagram of a modified embodiment of an antenna system of the present invention.
Figure 18:
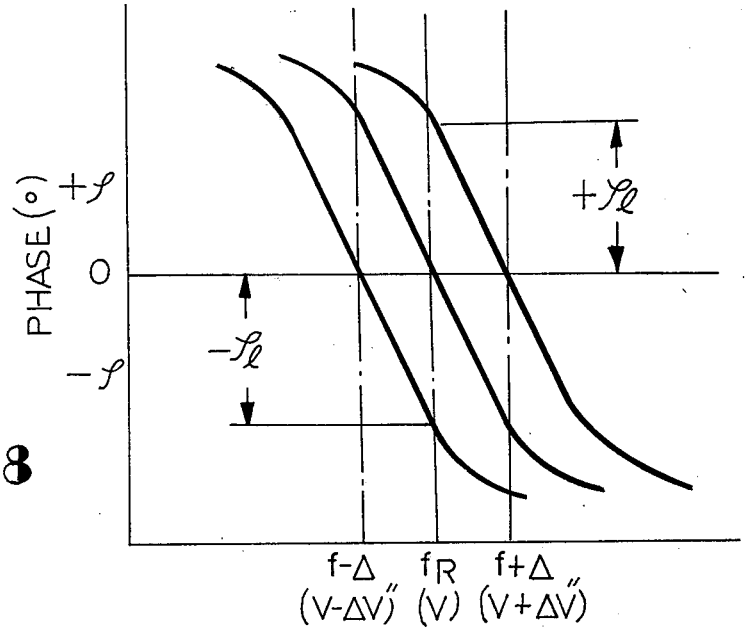
FIG. 18 is a view showing the phase characteristics of the dipole antennas of one embodiment of the present invention.

FIG. 17 shows an embodiment of the antenna device of the present invention, in which reference numerals 103 and 104 designate first and second dipole antennas disposed opposite to each other at a regular interval. Variable condensers contained within the first and second dipole antennas 103 and 104 are provided with a signal main control signal V from the main variable tuning control means 115 overlapped with a sub-control signal $+\Delta V$ or $-\Delta V$ from sub-variable tuning control means 112. The phase characteristics of the dipole antennas 103 and 104, when supplied with a control signal $V+\Delta V$ which is larger than the control signal V supplied around the moment of applying the signal V as shown in FIG. 18, leads in phase and, when supplied with a control signal $V-\Delta V$ which is smaller than signal V, lags in phase; thereby being controlled to tune the antennas.

Figure 19A:
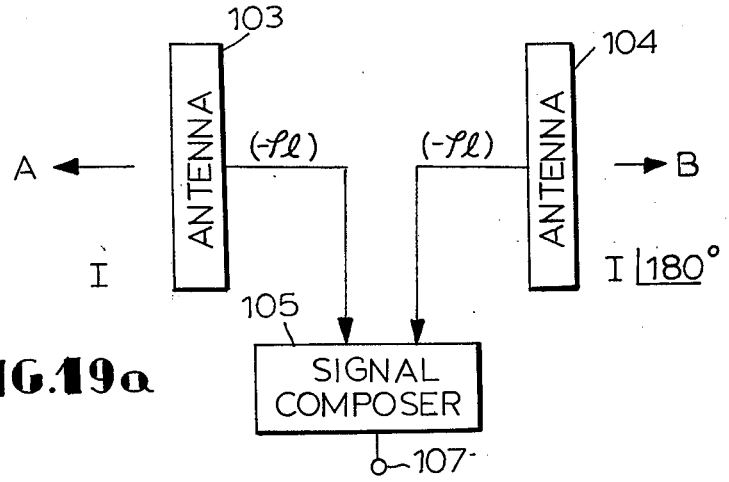
FIGS. 19-*a* and -*b*, 20-*a* and -*b*, 21-*a* and -*b*, and 22-*a* and -*b*, are views explanatory of function of the dipole antennas of one embodiment of the present invention.
Figure 19B:
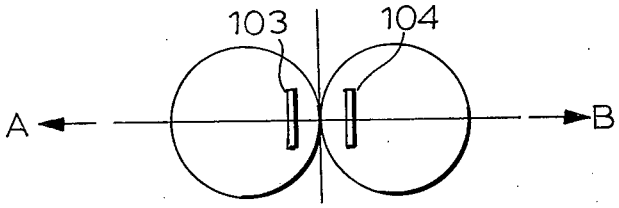
Figure 20A:
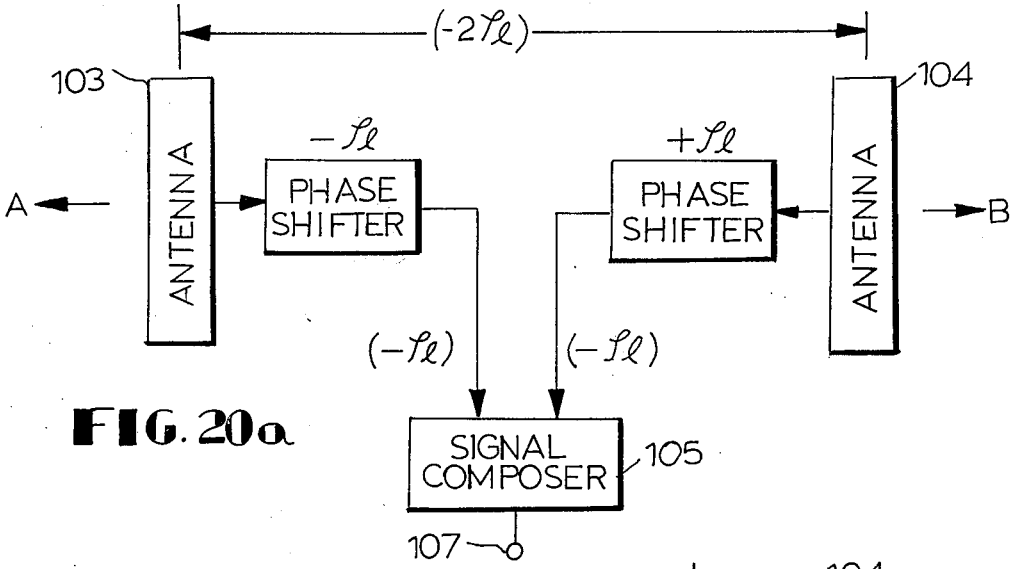
Figure 20B:
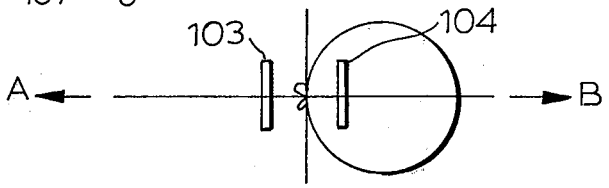

In the antenna device constructed as above, if it is assumed that the variable tuning control means is set to a voltage $V_1=V_2=V$, an equal control signal V is applied to the first and second dipole antennas 103 and 104. Hence, the first and second dipole antennas 103 and 104, as shown in FIG. 19-*a*, are disposed opposite to each other in relation of having phase difference of 180° viewed from the signal composer 105, thereby making its directivity characteristic in a shape of the FIG. 8 as shown in FIG. 19-*b*. If the tuning control means is assumed to be set to voltages $V_1=V-\Delta V''$ and $V_2=V+\Delta V''$, the first and second dipole antennas 103 and 104 are supplied with control signals of different quantities to thereby be disposed opposite to each other in relation of having a phase difference of $-2\psi_e$ viewed from the signal composer 105 as shown in FIG. 20-*a*, thus allowing its directivity characteristic to have the maximum sensitivity axis at the B side. In this instance, briefly, a phase difference feed type antenna device is provided.

Figure 21A:
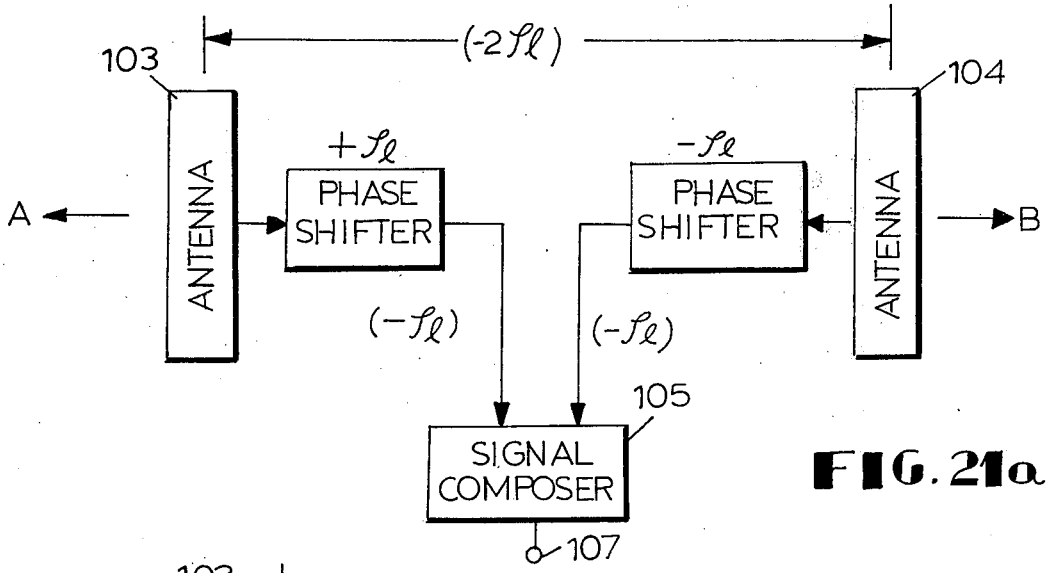
Figure 21B:
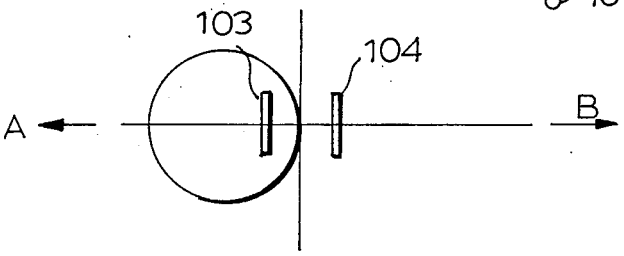

When the tuning control means is assumed to be set at voltages $V_1=V+\Delta V''$ and $V_2=V-\Delta V''$, the first and second dipole antennas 103 and 104 are disposed opposite a each other in relation of having a phase difference of $-2\psi_e$ viewed from the signal composer 105 as shown in FIG. 21-*a*. Hence, in directivity characteristic becomes to have the maximum sensitivity axis at the A side as shown in FIG. 21-*b*. In brief, a phase difference feed type antenna device also is provided.

Figure 22A:
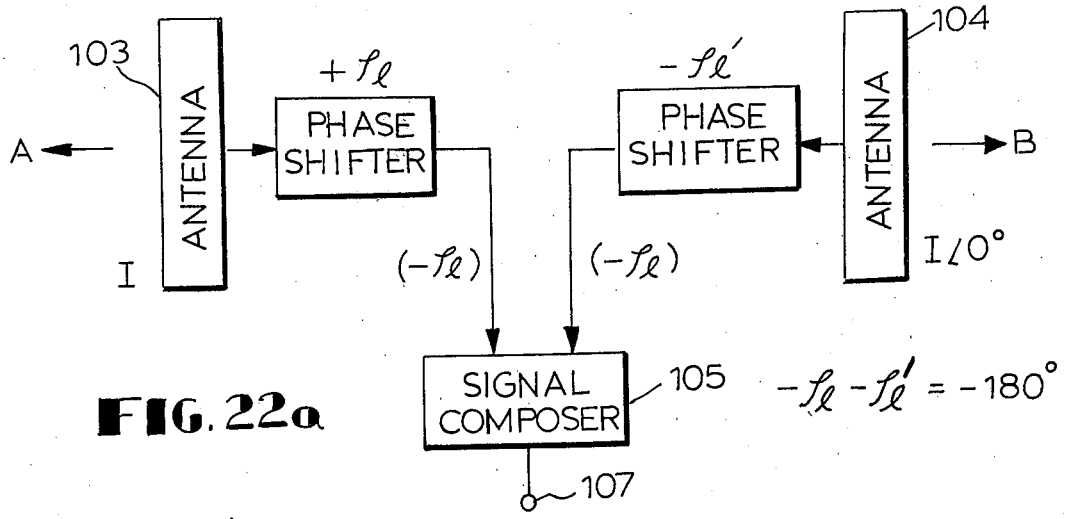
Figure 22B:
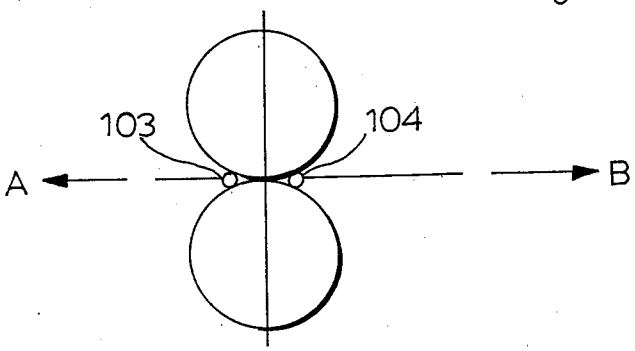

Particularly, if the tuning control means is assumed to be changed over to voltages $V_1=V+\Delta V''$ and $V_2=V-\Delta V''$, the first and second dipole antennas 103 and 104 are applied with control signal in relation of having a phase difference of 180° to thereby be disposed opposite to each other in relation of being in-phase viewed from the signal composer 105 as shown in FIG. 22-*a*, thus having the directivity characteristic in shape of the FIG. 8 as shown in FIG. 22-*b*.

Figures 23A, 23B, 23C, 23D, 23E:
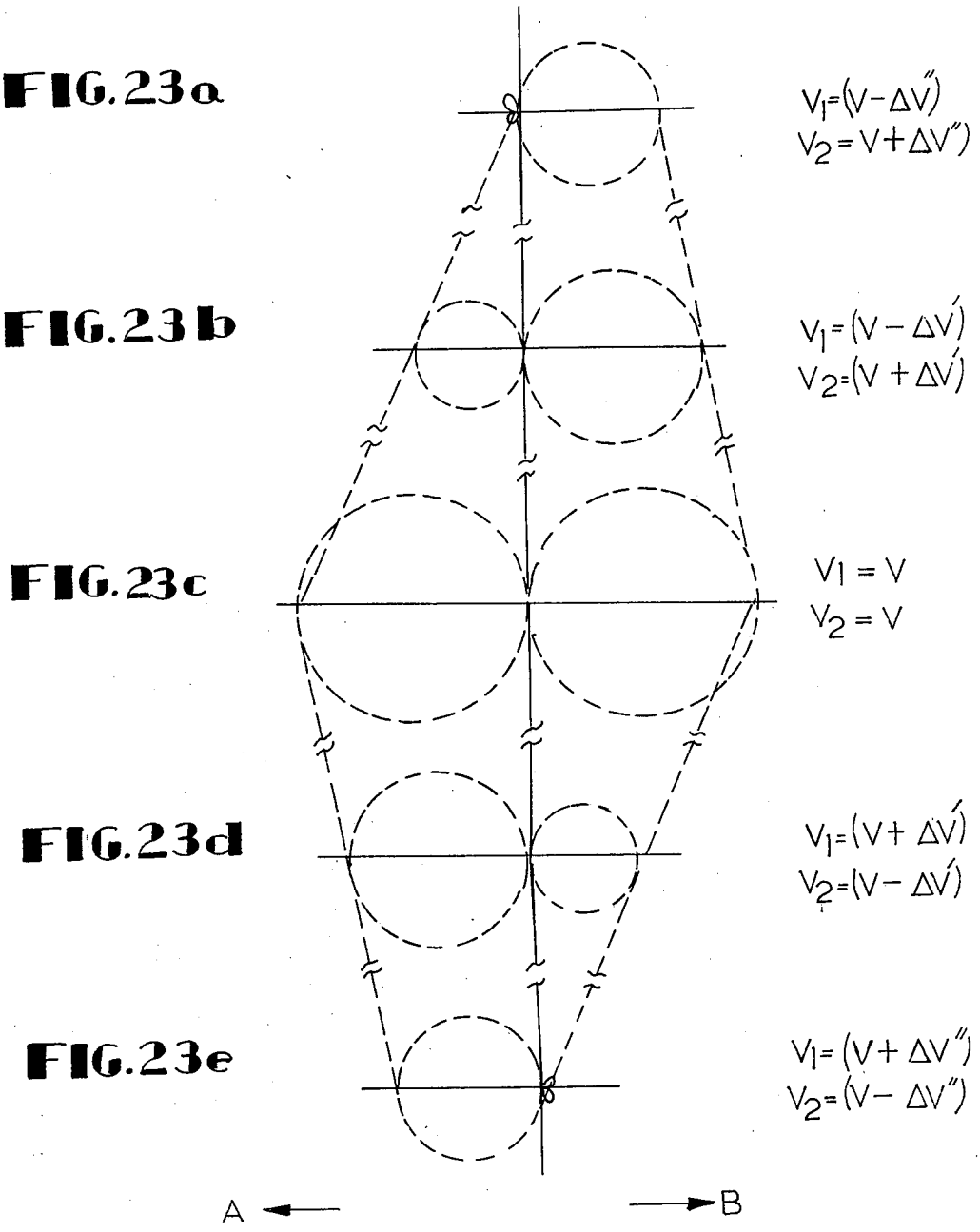
FIGS. 23-*a* through -*e* are patterns of the directivity characteristics of an antenna system of the present invention.

The control signal V of main variable-tuning controller 115 is fixed to control the quantity and code of sub-control signal $\Delta V$ at the subvariable-tuning controller 112, whereby the relative performance gain characteristics have a relationship as shown in FIGS. 23*a–e*, that is, as shown in FIG. 23-*c* with respect to FIG. 19, in FIG. 23-*a* with respect to FIG. 20, and in FIG. 23-*e* with respect to FIG. 21. In other words, when tuning control voltage $V_1$ and $V_2$ at the dipole antennas 103 and 104 are equal to a voltage V, a bilateral directivity characteristic of the maximum sensitivity axes at both the A and B sides is represented, in which the highest performance gain is obtained in comparison with other cases. On the other hand, when tuning control voltages $V_1$ and $V_2$ at dipole antennas 103 and 104 are set at $V_1<V_2$, the directivity characteristic which is unilateral and having the maximum sensitivity axis at the B side is represented as shown in FIG. 23-*a*. When sub-control signal $\Delta V$ is $\Delta V''$ in FIG. 23-*a*, a back gain axial of the A side becomes zero so that the so-called front-to-back ratio becomes infinite, but a front gain axial of the B side becomes lower. When sub-control signal $\Delta V$ is $\Delta V'$ smaller than $\Delta V''$ as shown in FIG. 23-*b*, the front-to-back ratio and forward gain present about middle characteristic. On the contrary, when the tuning control voltages $V_1$ and $V_2$ at the dipole antennas 103 and 104 are set at $V_1>V_2$, the directivity characteristics which is unilateral and having at the A side the maximum sensitivity axes appear as is shown in FIGS. 23-*d* and -*e*. In the case shown in FIG. 23-*e*, the back gain axial of the B side, when sub-control signal $\Delta V$ is $\Delta V''$, becomes zero to make infinite the so-called front-to-back ratio, but the front gain axial of the A side becomes lower. When sub-control signal $\Delta V$ is equal to $\Delta V'$ which is smaller than $\Delta V''$ as shown in FIG. 23-*d*, the front-to-back ratio and frontward gain is represented by about medium characteristics.

Figure 24A:
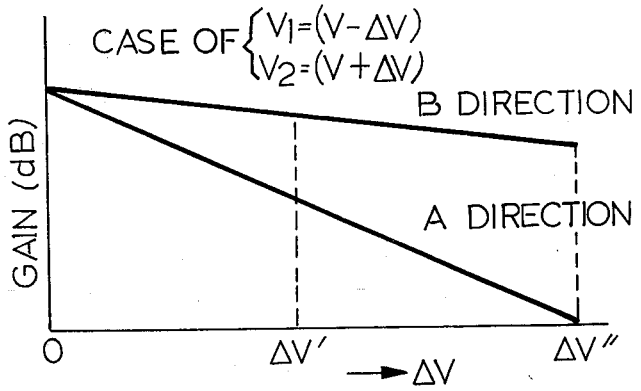
FIGS. 24-*a* and -*b* are views showing the gain characteristics of an antenna system of the present invention.
Figure 24B:
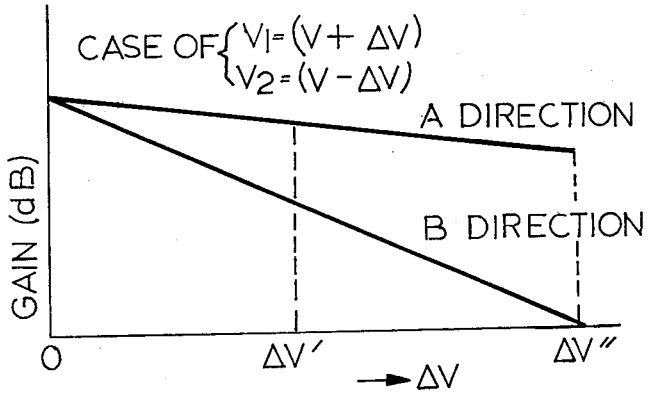

In addition, the broken lines in FIGS. 23*a—e* show envelopes for gain values on the axes of A and B sides, its characteristics being shown in FIGS. 24-*a* and -*b*, FIG. 24-*a* showing the characteristics when shown in FIGS. 23-*a* through -*c*, FIG. 24-*b* showing those when shown in FIGS. 23-*c* through -*e*.

Figure 25A:
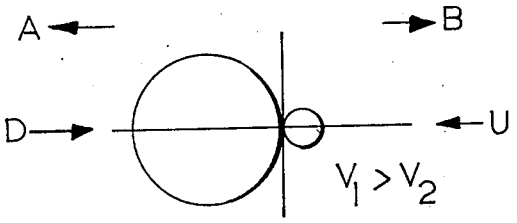
FIGS. 25-*a* and -*b* are views explanatory of the direction setting of an antenna system of the present invention.
Figure 25B:
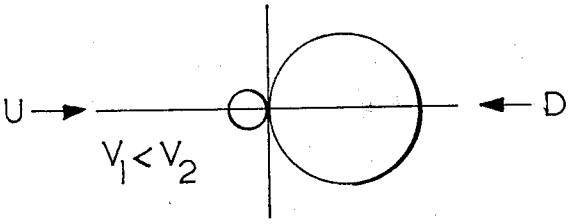

In FIG. 17, reference numeral 105 designates a signal composer connected to the first and second dipole antennas 103 and 105 through coaxial cables 106*a* and 106*b* of equal length; 107 designates a feed terminal for the signal composer 105, and 108 designates a receiver connected to the feed terminal 107, the receiver 108 being connected with a multipath detector 109 which detects multipath influence component included in intermediate-frequency picked up from a high portion of dynamic range at an intermediate-frequency disposal unit and converts the component into d.c. component. Output signal detected by the multipath detector 109 is compared in level by a comparator 110 with reference signal insert generator 111. If the multipath detection signal is higher in level than the reference signal level, comparison to judge output of "1" is obtained. On the other hand, when the multipath detection signal is lower than the reference level, for example, the comparison to judge output of "0" is obtained, in which the reference signal of reference signal generator 111 is previously desireably set in a level equivalent to multipath D/U under detection limit where the multipath influence is not detected in demodulation output of receiver 108. The output signal of "1" or "0" from the comparator 110 is fed as control signal to a sweep controller 112, output signal $\Delta V$ of the sweep controller 112 being supplied to signal adders 113 and 114. The adders 113 and 114 operate correspondingly to the additive polarity of output signal $\Delta V$ from the sweep controller 112 with respect to turning control signal V of tuning controller 115, the additive polarity being decided by additive polarity controllers 116 and 117 as to either the polarity is plus addition or minus addition. In brief, voltage $V+\Delta V$ when in plus addition, and $V-\Delta V$ when in minus addition, are supplied as tuning signals $V_1$ or $V_2$ for dipole antennas 103 and 104, where output signal $\Delta V$ from sweep controller 112, when its input signal is "1", operates in the direction of increasing sweep, or when it is "0", operates in the direction of decreasing sweep. A relationship between values of output signal $\Delta V$ of sweep controller 112 and the directivity characteristic of antenna unit according to the additive polarity, is shown in FIGS. 23*a–e*. In detail, when signal $\Delta V$ is 0, the characteristics of shape of the FIG. 8 is obtained as shown in FIG. 23-*c* and the maximum sensitivity axes exist at the A and B sides respectively, whereby its performance gain is the highest in comparison with other cases. When in relation of $V_1 < V_2$, the characteristics unilateral or like this is obtained as shown in FIGS. 23-*a* and -*b*. For example, when signal $\Delta V$ is $\Delta V''$, the characteristics is as shown in FIG. 23-*a*, in which the performance gain on the axis at the A side becomes zero, and the front-to-back ratio becomes infinite, out performance gain becomes lower. When signal $\Delta V$ is equal to $\Delta V'$ which is smaller than $\Delta V''$, the characteristics is shown in FIG. 18-*b*, in which the front-to-back ratio and performance gain are about medium. On the contrary, when the tuning signals have the relationship of $V_1 > V_2$, the characteristic becomes unilateral or near it, and, for example, when signal $\Delta V$ is equal to $\Delta V''$, the characteristic is as shown in FIG. 23-*e*. Hence, performance gain on the axis at the B side becomes zero and the front-to-back ratio becomes infinite, but the performance gain lowers. When signal $\Delta V$ is equal to $\Delta V'$ which is smaller than $\Delta V''$, then the characteristic is as shown in FIG. 23-*d* so that the front-to-back ratio and performance gain are about medium. In addition, the broken lines in FIGS. 23*a–e* are envelopes of performance gain values on the axes at the A and B sides. FIGS. 24-*a* and -*b* show the characteristics of gain, in which FIG. 24-*a* shows it for FIGS. 23-*a* through -*c* and FIG. 24-*b* shows it for FIGS. 23-*c* through -*e*. Additive polarity controllers 116 and 117 set the additive polarities in such a manner that when a desired signal D comes from the A side and undesired signal U giving multipath interference comes from the B side as shown in FIG. 25*a*, $V_1$ is made larger than $V_2$ so that the directivity characteristic as shown in FIG. 25-*a* is obtained, that, is, the additive polarity controller 116 is set to be plus addition and the additive polarity controller 117 is set to be minus addition. On the contrary, when desired signal D comes from the B side and undesired signal U comes from the A side, the additive polarities are set as shown in FIG. 25-*b*. By this, the antenna's directivity, thereafter, is automatically set so that the multipath D/U signal ratio fed to the receiver 108 becomes under the previously set detection limit. The directivity is automatically set to make the multipath D/U signal ratio maximum under the detection limit and the desired signal D maximum, thereby setting the directivity in best receiving condition under distribution of radio waves. Needless to say, control signal V by tuning controller 115 is set desirably variably so that tuning frequency of antenna device may be desirably variably set.

FIGS. 26 through 29 are views explanatory of a receiving device having at least two antenna elements disposed opposite to each other at a desired interval.

Figure 26:
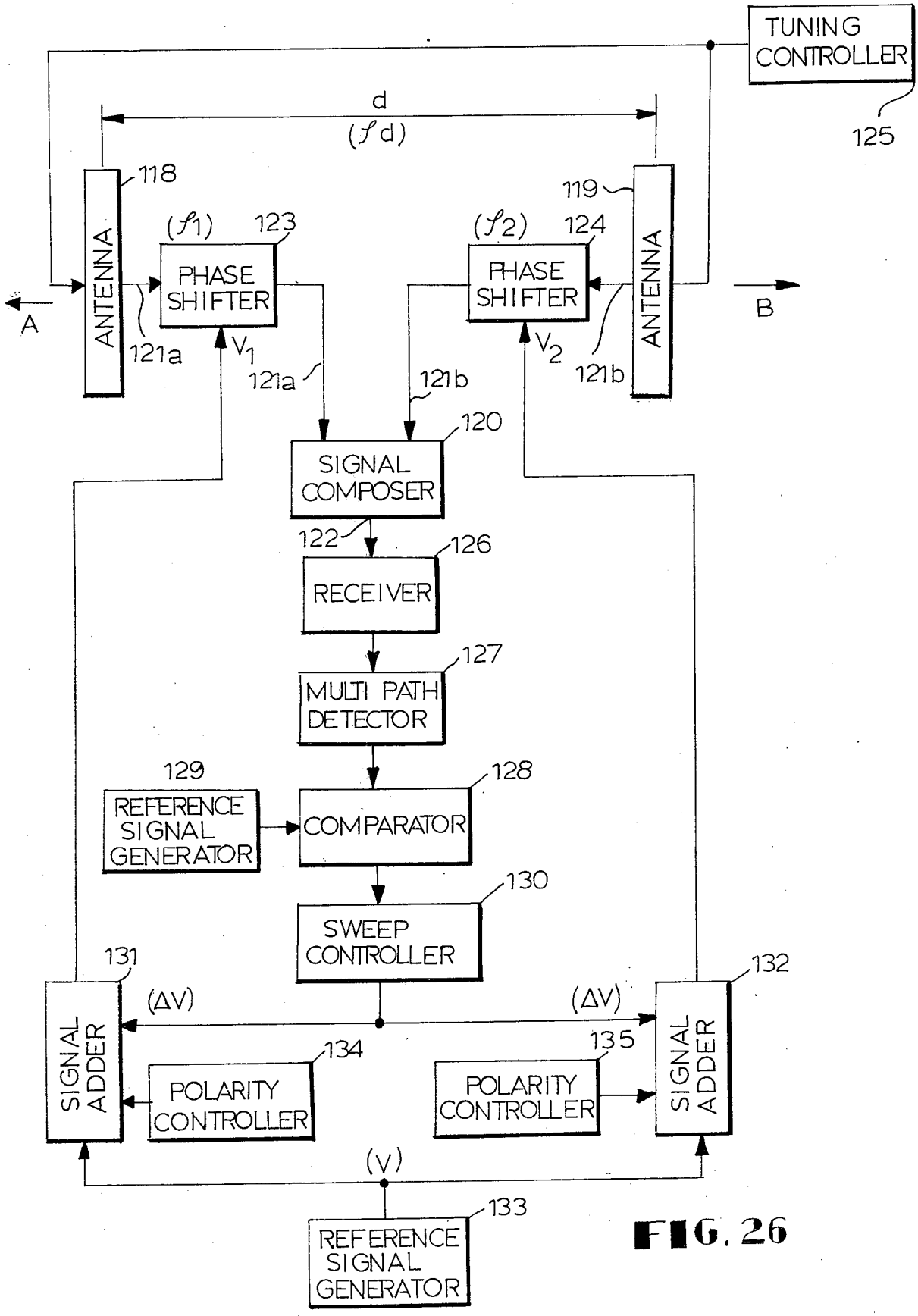
FIG. 26 is a block diagram of still another modified embodiment of the antenna unit of the present invention.

FIG. 26 represents an embodiment of the receiving device of the invention, in which 118 and 119 designate first and second dipole antennas disposed opposite to each other at a desired interval d; 120 designates a signal composer connected to the first and second dipole antennas 118 and 119 by way of coaxial cables 121*a* and 121*b* of equal length; 123 and 124 designate first and second variable phase shifters interposed at a desired intermediate portion along the coaxial cables 121*a* and 121*b*; and 125 designates a tuning controller for variably controlling the first and second dipole antennas 118 and 119.

Figure 28A:
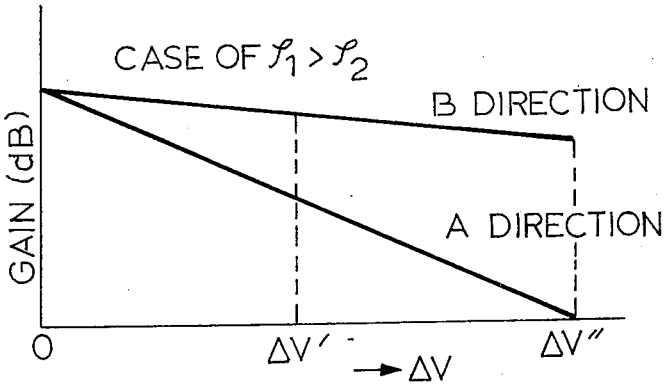
FIGS. 28-*a* and -*b* are views showing gain characteristics of an antenna system of the present invention.
Figure 28B:
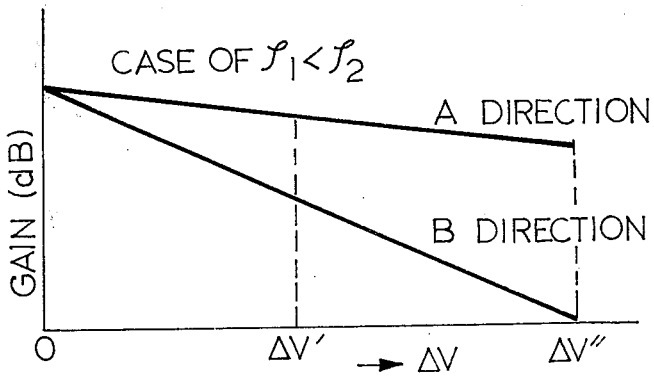
Figures 27A, 27B, 27C, 27D, 27E:
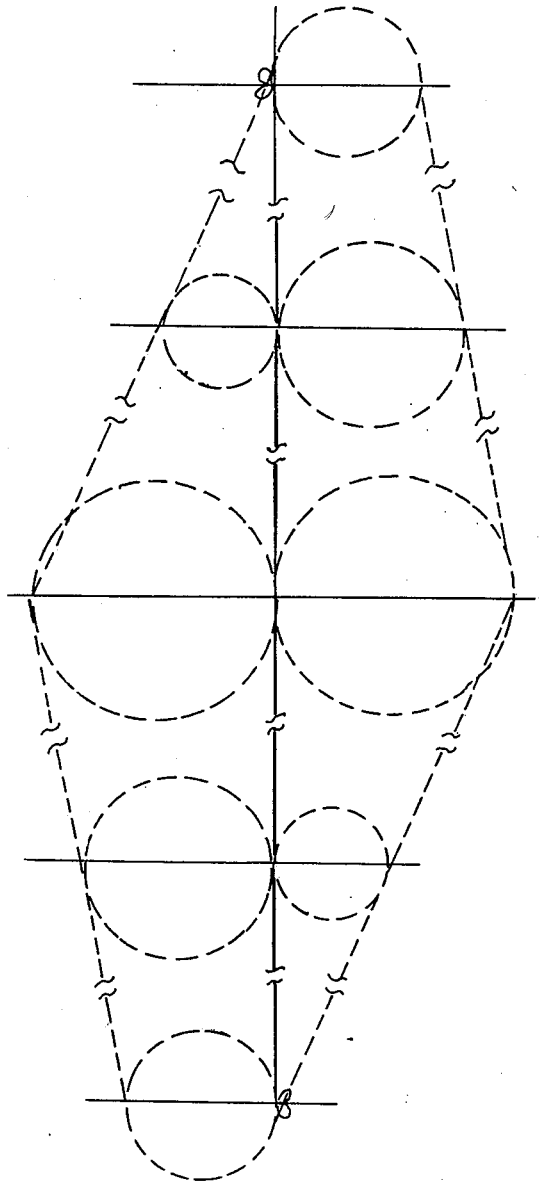
FIGS. 27-*a* through -*e* are patterns of the directivity of an antenna system of the present invention.

Reference numeral 126 designates a receiver connected to a feed terminal 122. The receiver 126 connects to a multipath detector 127 which detects the multipath influence component included in the intermediate-frequency signal picked up from a high portion in a dynamic range at an intermediate frequency disposal unit of the receiver. A detection output signal of the multipath detector 127 is compared in level by a comparator 128 with the reference signal level of reference signal generator 129. If the multipath detection signal is higher than the reference signal level, for example, a comparison judgment output of "1" is obtained. If the multipath detection signal is lower than the reference level, a comparison judgment output of "0" is obtained, where the reference signal of reference signal generator 129 is previously desirably set to a level equivalent to, for example, the multipath D/U which is under the detection limit in which its influence is not detected in the demodulation output of receiver 126. Output signal of "1" or "0" of comparator 128 is supplied as a control signal to a sweep controller 130. The output signal $\Delta V$ of sweep controller 130 is fed into signal adders 131 and 132. The signal adders 131 and 132 operate respectively due to the additive polarities of output signal $\Delta V$ of sweep controller 130 with respect to reference signal V of reference signal generator 133, the additive polarities being controlled by additive polarity controllers 134 and 135 as to either the polarity is plus addition or minus addition. In a case of plus addition, an output signal $V+\Delta V$ is supplied as control signal $V_1$ for variable phase shifter 123 and in a case of minus addition, $V-\Delta V$, as control signal $V_2$ for variable shifter 124, where an output signal $\Delta V$ of sweep controller 130, when an input signal, for example, is "1", operates in the direction of increasing sweep and, when it is "0" operates in the direction of increasing sweep. The relationship of output signal $\Delta V$ of sweep controller 130 with a phase shift amount $\psi_1$ of phase shifter 123 and that $\psi_2$ of shifter 124 is represented as follows: if $V_1=V_2=V$, the relationship of $\psi_1=\psi_2$ is obtained, if $V_1=(V-\Delta V)$, $\psi_1>\psi_2$ and if $V_1=(V-\Delta V)$, $\psi_1>\psi_2$. Next, the relationship of phase shift amounts $\psi_1$ and $\psi_2$ and that between phase shift amounts of space propagation delay $\psi d$ of the radio wave and the directivity characteristic of the antenna unit are shown in FIGS. 27*a–e*, in which if $\psi_1=\psi_2$, the characteristic is of a shape of the figure as shown in FIG. 27-*c* and the maximum sensitivity axes are at the A and B sides and its performance gain is the highest in comparison with other cases. If $\psi_1>\psi_2$, the characteristic becomes unilateral, and if $|\psi_2=\psi_1|=\psi d$, the characteristic shown in FIG. 27-*a* is obtained, in which performance gain on the axis at the A side becomes zero and the front-to-back ratio becomes infinite, but the performance gain lowers. If $|\psi_2-\psi_1|<\psi d$, the characteristic is as shown in FIG. 27-*b*, in which the front-to-back ratio and performance gain are about medium. On the contrary, if $\psi_1<\psi_2$, the characteristic which is unidirection as shown in FIGS. 27-*d* and -*e* is obtained, and if $|\psi_2-\psi_1|=\psi d$, the characteristic is as shown in FIG. 27-*e*, in which performance gain on the axis at the B side becomes lower. If $|\psi_2-\psi_1|<\psi d$, the characteristic shown in FIG. 27-*d* is obtained, in which the front-to-back ratio are about medium. In addition, the broken lines in FIGS. 27*a–e* represent envelopes of performance gain values on the axes at the A and B sides. FIGS. 28-*a* and -*b* show its characteristic, FIG. 28-*a* shows the characteristics for FIGS. 27-*a* and -*c*, and FIG. 28-*b* shows characteristics for FIGS. 27-*c* through -*e*.

Figure 29A:
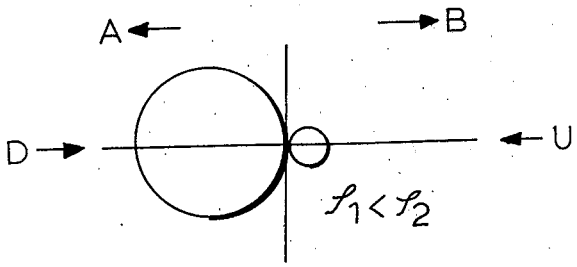
FIGS. 29-*a* and -*b* are views explanatory of the direction setting of an antenna system of the present invention.
Figure 29B:
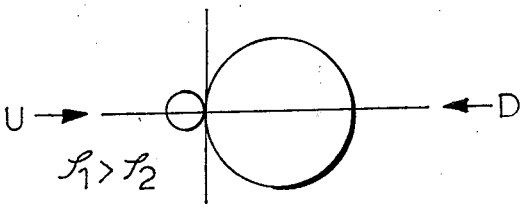

Additive polarities by additive polarity controllers 134 and 135 are set in $\psi_1<\psi_2$ to have the directivity characteristic of FIG. 29-*a* when desired signal D comes from the A side and undesired signal from the B side, in other words, the additive polarity controller 134 is set in minus addition and that 135 in plus addition. On the contrary, the additive polarities, when desired signal D comes from the B side and undesired signal U from the A side, are set as shown in FIG. 29-*b*. Such setting, thereafter, enables the antenna to automatically set its directivity so that multipath D/U fed into receiver 126 becomes under the previously set detection limit. Since the directivity is automatically set to make the multipath D/U maximum within the detection limit and the desired signal D maximum, the directivity is set in best conditions under radio wave distribution. Needless to say, the control signal by tuning controller 125 is optionally variably set to enable optional variable-control of tuning frequency of antenna device.

In this instance, multipath detector 127 can use, for example, a detecting system which detects amplitude modulation component by multipath of intermediate frequency in a level zone free from a limiter and detects it as d.c. voltage output.

Figure 30:
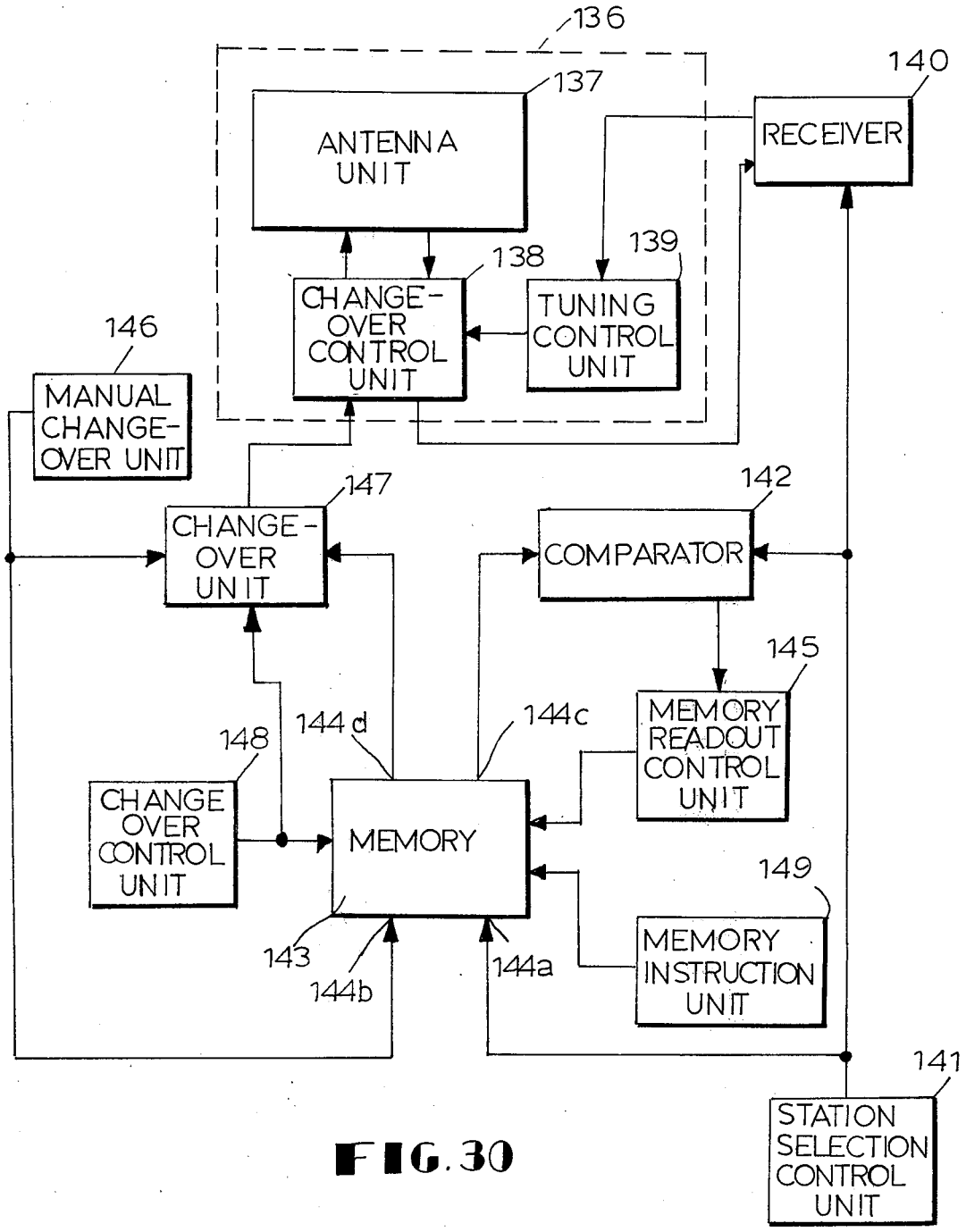
FIG. 30 is a block diagram of another modified embodiment of the antenna system of the present invention.

FIG. 30 is a view explanatory of the invention relating to a system is which a pair of dipole antennas disposed opposite to each other are disposed perpendicularly to a pair of dipole antennas disposed opposite to each other, so that the directivity changeover of antenna device having antenna elements of total four dipole antennas is associated with station-selection changeover of receiver connected to the antenna device.

FIG. 30 is a block diagram of the antenna system of the invention, in which reference numeral 136 designates the aforesaid antenna device shown in FIG. 2. The antenna system comprises an antenna constituting unit 137 including the dipole antennas 8 through 11 and signal composers 12 and 14, a changeover control unit 138 including changeover control means 20 and 21 and signal composer 16, and a tuning control unit 139 for the tuning control means 18 including control signal sources 19*a* through 19*c*. Feed terminal 17 of signal composer 16 within the changeover control unti 138 is connected to an antenna terminal of digital control station-selection receiver 140 (hereinafter referred to merely as receiver 140) to thereby feed thereto a receiving signal. While, receiver 140 is associated with tuning control unit 139 so that a control signal from the receiver 140 corresponds to the receiving frequency at the tuning control unit 139. Station-selection of receiver 140 is controlled by output code of station-selection control unit 141, the station-selection control code is fed to receiver 140 and also to writing-in input terminal 144*a* for code comparator 142 and memory unit 143. Another signal compared by the code comparator 142 is the output code from output terminal 144*c* of the memory unit 143, so that when the station-selection code at station selection unit 141 coincides with the read-out output code from output terminal 144*c* of memory unit 143, an accordance output signal is output and fed to memory read-out control unit 145 so that the former transfer operation of stored content of memory unit 143 is stopped. Into another write-in-input terminal 144*b* is fed a control output code of the manual changeover control unit in the direction of the antenna pattern, the code is transferred within the memory unit 143 by control of the readout control unit 145 so as to be fed to one of input terminals of the code line changeover unit 147. The control output code from the manual changeover unit 146 is fed into the other input terminal of the code line changeover unit 147. Hence, a mode changeover signal for changing over the write-in-mode and readout mode of memory unit 143, for change over of the readout output code of the readout terminal 144*d* is applied to changeover control unit 147 when the memory unit is in write-in mode and the control output code of the manual changeover control unit is in the readout mode. Both the station-selection control code of the station-selection control unit 141 fed into write-in input terminal 144*a* and the changeover control code of the manual changeover control unit 146, are apt to be stored simultaneously at the same address when the memory mode changeover control unit 148 is set in its write-in mode and the memory instruction code of the memory instruction unit 149 is fed thereto. Thereafter, a set of two kinds of codes are simultaneously transferred toward readout output terminals 144*c* and 144*d* from the memory readout control 145 through addresses of the predetermined order, thereby keeping the codes in condition of standing by. When memory mode changeover control unit 148 is switched to a readout mode, the set of two kinds of codes are output to the readout output terminals 144*c* and 144*d*.

As seen from the above, the desired combination of a plurality of different codes of the station-selection code of the receiver and the optimum antenna direction changeover control code, is stored in memory unit 143. Thereafter, only the station-selection control code is set by selection control of station-selection control unit 141 to thereby simultaneously set the antenna electronically in the optimum direction. In other words, until the set station-selection control code and the station-selection code (which has been previously stored within memory unit 143 and is subsequently read out), are compared by the code comparator and are in accord with each other, memory readout control unit 145 continuously outputs transfer instruction signals and is kept in its transfer operation condition. When both the codes are compared and are in accord so that accordance output signal is supplied to memory readout control unit 145, the above-noted continued transfer operation is stopped. The transfer of the stored contents of memory unit 143 is carried out in a ring shift technique of sequentially shifting from write-in input terminal 144*a*, 144*b* to readout output terminals 144*c* and 144*b* and of returning to the write-in input terminals 144*a* and 144*b*, where the directivity shown in FIGS. 7-*a* through -*k* and changeover control code applied to changeover control unit 138, are, of course, set previously in the condition of independent combination and accordance. Needless to say, switching of changeover control unit 138 by changeover control code, as shown in FIG. 7, employs, for example, simple relay switches for the terminals 1 to 4 and 7 to 9, and employs coaxial relay switches for the terminals 5 and 6 and those 10 and 11 and matching resistance R. The receiver 140 may be a digital control station-selection receiver of a closed loop type using a PLL synthesizer, or may be of an open loop-block type using a D/A converter.

The antenna unit 137 in FIG. 30 may use the modified embodiment of the antenna unit as shown in FIGS. 10 through 12, or another modified embodiment thereof as shown in FIGS. 13 through 15, instead of the embodiment shown in FIG. 2, thereby obtaining the same construction and effect.

Figure 31:
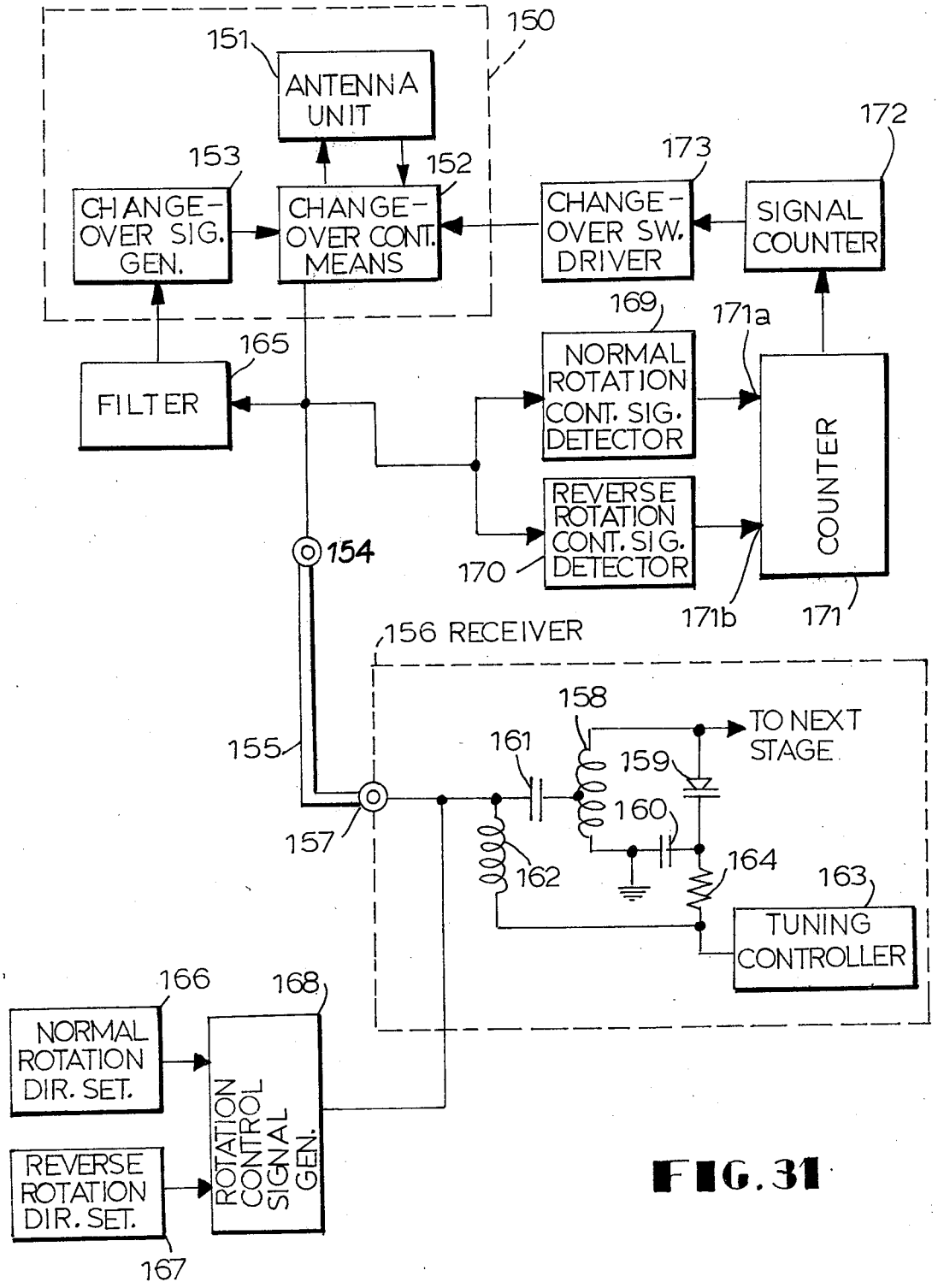
FIG. 31 is a block diagram of still another embodiment of the antenna system of the present invention.

FIG. 31 is a view of explanation of the antenna device of the present invention, which is so constituted that a pair of dipole antennas disposed opposite to each other are arranged perpendicularly to a pair of dipole antennas disposed opposite to each other so that the antenna device of antenna elements comprising total four dipole antennas is controlled and set in its directivity.

An object of the present invention is to allow the tuning control signal of each dipole antenna, the directive signal controlling directivity of antenna unit, and the receiving or transmitting signal, to communicate with each other by way of one coaxial cable connecting the antenna unit with the receiver or transmitter.

FIG. 31 is a system block diagram of antenna device of the present invention, in which reference numeral 150 designates the antenna unit shown in FIG. 2. The antenna unit 150 comprising an antenna constituting unit 151 including dipole antennas 8 through 11 and signal composers 12 and 14, a changeover control unit 152 including changeover control means 20 and 21 and signal composer 16, and changeover signal generating unit 153 for tuning control means 18 including control signal sources 19*a* through 19*c*. Feed terminal 17 at signal composer 16 within changeover control unit 152 is connected with the feed terminal of the antenna device and then antenna terminal 157 at receiver 156 through coaxial cable 155. Receiver 156 is provided with a pretuning circuit comprising coil 158, voltage control variable reactance element 159 and capacitor 160, and is connected to the antenna terminal through capacitor 161. Also, a tuning control signal line from tuning controller 163 provided within receiver 156 is connected to antenna terminal 157 through choke coil 162.

Tuning control signal V from tuning controller 163 is fed to voltage control variable reactance element 159 through high frequency blocking resistance 164. The tuning control signal V supplied through coaxial cable 155 is supplied to changeover control signal generator 153 by way of low-pass filter 165. The required changeover signals V, $V+\Delta V$ and $V-\Delta V$ are changed over to be supplied to antenna element constituting unit 151 through changeover control unit 152. Hence, the antenna tuning frequency of antenna unit 150 and the tuning frequency of receiver 150 may be arranged so as to track in frequency when the variable reactance element used for antenna constituting unit 151 and that used for receiver 156 are similar in type. Thus, it is possible to carry out the overlapping transmission of the receiving signal and the tuning control signal by way of coaxial cable 155.

On the other hand, the directivity control of antenna is carried out in such a manner that the directivity rotation control signal generated from the directivity rotation control signal generator 168 by means of the signal set by normal rotation directivity setter 166 or reverse rotation directivity setter 167 is supplied to antenna terminal 157, transmitted through coaxial cable 155, discriminated and detected by normal rotation control signal detector 169 or reverse rotation control signal detector 170, and fed into counter 171, thereby being counted, the count output being converted into the changeover control signal by the signal converter 172 and fed into the changeover control unit 152 through changeover switch driver 173, thereby properly changing over the changeover switch. The form of the directivity rotation control signal, in the case of normal rotation control signal, can be distinguished in polarity direction by a positive polarity pulse signal, and, in a case of reverse rotation control signal, by a negative polarity pulse signal. Another form of directivity rotation control signal, in the case of normal rotation control signal, can also be distinguished by its pulse signal frequency of a relatively high frequency signal and in the case of reverse rotation control signal by a relatively low frequency signal. Needless to say, the above-noted pulse signal itself or its high frequency is arranged so as not to affect the receiving frequency zone of the receiver. The normal or reverse rotation control signal generators 169 or 170, when the directivity rotation control signal is distinguished directionally by the polarity direction of pulse signals, detects each polarity, discriminates the passing or blocking of the pulse signal, and feeds the pulse signal into control signal counter 171 to thereby add or subtract it. When the directional distinction is due to detection of the pulse signal frequency, the inherent frequency of each pulse signal is detected to discriminate the passing or blocking of the pulse signal and then similarly processed.

The relationship between the pulses of the directivity rotation control signal and the antenna direction changeover of antenna unit 150 is enough to allow rotation at one degree of minimum resolution angle at direction changeover to correspond with respect to one bit of the pulse signal. In order to control the directivity rotation at a desired speed, said pulse signal frequency may be desirably variable, or a suitable frequency divider may be provided ahead of the control signal counter 170. The control signal counter 171 may also be a conventional pulse counter having an addition mode signal input terminal 171*a* and a subtraction mode signal input terminal 171*b*.

Alternatively, this antenna system of the present invention can fulfill a similar functional effect when used with a transmitter system.

As clearly understood from the above description, this invention can overlap-transmit three kinds of receiving or transmitting signals, directivity rotation control signals, and tuning tracking control signals without effecting each other by way of one coaxial cable connecting the antenna unit with the receiver or transmitter. Therefore, only one coaxial cable is enough for a connecting cable necessary to perform the directivity rotation remote control of an antenna unit when the antenna system and receiver or transmitter system are separated by a very long distance, thereby remarkably reducing the cost to install the cable in comparison with conventional techniques. Furthermore, the device of optionally variably directivity rotation direction and rotation speed can be effected with simple construction of circuitry and parts, thereby enabling the reduction of power consumption and enabling the continuous operation for a long period of time.

What is claimed is:

1. A directivity control antenna system comprising: an antenna unit having first through fourth dipole antennas in which two-terminal variable reactance circuits are respectively connected to a pair of antenna elements and an impedance adjusting capacitor is connected between feed terminals of said pair of antenna elements; a first signal combiner connected to said first and second dipole antennas of said first through fourth dipole antennas, which are disposed opposite to each other, by feed lines of equal length with respect to said first and second dipole antennas for combining signals from said first and second dipole antennas; a second signal combiner connected to said third and fourth dipole antenna of said first through fourth dipole antennas, which are disposed opposite to each other are perpendicular to said first and second dipole antennas, by feed lines of equal length with respect to said third and fourth dipole antennas for combining signals from said third and fourth dipole antennas; tuning control means for supplying a plurality of DC voltages which are different from each other; changeover control means coupled to said tuning control means for selectively supplying said plurality of DC voltages from a first through a fourth output terminal thereof to said first through fourth dipole antennas for control of the reactances of said two terminal variable reactance circuits of said first through fourth dipole antennas so as to control the directivity of said antenna system, said changeover control means being also coupled to said first and second signal combiners for selectively passing output signals from said first and second signal combiners to a fifth and a sixth output terminal thereof; and a third signal combiner coupled at two input terminals thereof to said fifth and sixth output terminals of said changeover control means for outputting, to a receiver, output signals of said first or second signal combiner or combined output signals of said first and second signal combiners, wherein connection of said first and second signal combiners to said third signal combiner via said changeover control means made is by feed lines of equal length with respect to said first and second signal combiners.

2. A directivity control antenna system according to claim 1, wherein said plural DC voltages are obtained from a tuning voltage of said receiver for variably controlling said reactances of said two terminal variable reactance circuits of said first through fourth dipole antennas.

3. A directivity control antenna system according to claim 1 or 2, wherein said plurality of DC voltages comprise three voltages, and wherein the difference between the highest one of said three voltages and the middle one of said three voltages is equal to difference between the middle one of said three voltages and the lowest one of said three voltages.

4. A directivity control antenna system according to claims 1 or 2, wherein said antenna elements comprise transmission lines of a zigzag configuration, said lines having distributed inductance.

5. A directivity control antenna system according to claim 3, wherein said antenna elements comprise transmission lines of a zigzag configuration, said lines having distributed inductance.

* * * * *